US009448524B2

(12) United States Patent
Ino et al.

(10) Patent No.: US 9,448,524 B2
(45) Date of Patent: Sep. 20, 2016

(54) IMAGE FORMING APPARATUS

(71) Applicant: CANON KABUSHIKI KAISHA, Tokyo (JP)

(72) Inventors: Kazushi Ino, Suntou-gun (JP); Satoshi Nakashima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/096,432

(22) Filed: Dec. 4, 2013

(65) Prior Publication Data

US 2014/0169830 A1 Jun. 19, 2014

(30) Foreign Application Priority Data

Dec. 14, 2012 (JP) ..... 2012-273594
Nov. 28, 2013 (JP) ..... 2013-246517

(51) Int. Cl.
*G03G 15/00* (2006.01)
*G03G 21/18* (2006.01)
*G03G 15/01* (2006.01)

(52) U.S. Cl.
CPC ..... *G03G 15/757* (2013.01); *G03G 15/0131* (2013.01); *G03G 21/1857* (2013.01); *G03G 2215/0132* (2013.01)

(58) Field of Classification Search
CPC ..... G03G 15/757; G03G 21/1857
USPC ..... 399/167
See application file for complete search history.

(56) References Cited

U.S. PATENT DOCUMENTS 4,803,515 A 2/1989 Hoshino et al.
7,983,600 B2 7/2011 Abe et al.
8,335,458 B2 12/2012 Ino et al.
8,428,494 B2 4/2013 Ino et al.
2003/0152402 A1 8/2003 Ehara et al.
2007/0196130 A1* 8/2007 Okabe et al. ..... 399/167
2010/0278560 A1* 11/2010 Ino et al. ..... 399/167
2011/0064471 A1* 3/2011 Kim ..... 399/167

FOREIGN PATENT DOCUMENTS

JP 63-11967 A 1/1988
JP 6-324547 A 11/1994
JP 7-92761 A 4/1995
JP 2003-177632 A 6/2003
JP 2009151182 A * 7/2009
JP 2010-282185 A 12/2010

OTHER PUBLICATIONS

JP 2009151182 English translation, Ogawa, Jul. 2009.*

* cited by examiner

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

Provided is an image forming apparatus, including first and second drive portions respectively transmitting a drive force to first and second photosensitive drums, the first and second drive portions each including: a transmission gear rotated by the drive force; an idler gear rotated in mesh with the transmission gear; and a drive gear rotated in mesh with the idler gear. When a meshing angle of the idler gear is an angle from a meshing position between the idler gear and the transmission gear to a meshing position between the idler gear and the drive gear with respect to a rotation center of the idler gear, the meshing angles of the idler gears of the first and second drive portions are substantially equal to each other, and rotational phases of the idler gears of the first and second drive portions match with each other.

11 Claims, 9 Drawing Sheets

IMAGE FORMING APPARATUS

BACKGROUND OF THE INVENTION

1. Field of the Invention

The present invention relates to an image forming apparatus including a drive transmission device for driving a photosensitive drum and the like.

2. Description of the Related Art

Hitherto, as an electrophotographic image forming apparatus, a tandem type image forming apparatus for forming full color images has been provided. The tandem type image forming apparatus includes multiple image forming portions. Thus, depending on machine accuracy or the like, speed fluctuation or the like of multiple photosensitive drums and a transfer belt may occur unequally in respective colors, and images may be shifted when superimposing each other. In this way, color misregistration may occur.

There are two types of color misregistration, that is, regular color misregistration and irregular color misregistration. The regular color misregistration is caused by, for example, a failure in positioning during assembly of laser scanners of the respective colors. The irregular color misregistration is caused by, for example, rotational speed fluctuations of the photosensitive drums, drive rollers of the transfer belt, and the like.

In order to suppress the irregular color misregistration, frequency variation components of a drive system for the multiple photosensitive drums and the transfer belt need to be prevented from appearing in images. In Japanese Patent Application Laid-Open No. S63-11967, there has been proposed a technology for reducing image deterioration due to the frequency variation components. In the technology described in Japanese Patent Application Laid-Open No. S63-11967, the multiple photosensitive drums are driven by a common drive source, and arranged in a manner that a time interval in which the transfer belt passes adjacent transfer positions is equal to an integral multiple of a drive fluctuation cycle of the drive source.

Specifically, the photosensitive drums are arranged in a manner that a time interval from an exposure timing of a first photosensitive drum located on an upstream side in a transfer member moving direction to an exposure timing of a second photosensitive drum located adjacent to the first photosensitive drum and on a downstream side in the transfer member moving direction is substantially equal to an integral multiple of a drive fluctuation cycle of each idler gear. In addition, the photosensitive drums are arranged in a manner that a time interval from a transfer timing of the first photosensitive drum to a transfer timing of the second photosensitive drum is also substantially equal to the integral multiple of the drive fluctuation cycle of each of the idler gears.

This technology has a problem in that, in a case where the multiple photosensitive drums respectively have different meshing angles of the idler gears for transmitting a drive force to the photosensitive drums, rotational speeds of the photosensitive drums vary from each other at the same timing when transferring or exposing, resulting in the color misregistration.

FIG. 7 is a sectional view of a configuration of primary transfer rollers 12, photosensitive drums 1, and a drive transmission device 560 of a related art image forming apparatus. With reference to FIG. 7, the principle of occurrence of the color misregistration is described. In the color image forming apparatus illustrated in FIG. 7, a processing speed is set to 123.99 mm/s, a distance L between two colors is set to 53.74 mm, and a diameter of each of the photosensitive drums 1 (1Y, 1M, 1C, and 1K) is set to 24 mm. Drive gears 18 (18Y, 18M, 18C, and 18K) rotate the photosensitive drums 1 (1Y, 1M, 1C, and 1K) at a peripheral speed that is equal to the processing speed of 123.99 mm/s. Therefore, the number of rotations of each of the photosensitive drums 1 (1Y, 1M, 1C, and 1K) is expressed by $123.99/(\pi\times24)\approx1.644$ (rps).

The number of teeth of each of the drive gears 18 (18Y, 18M, 18C, and 18K) is set to 94, and the number of teeth of a pinion of each branch gear 30 is set to 67. Thus, the number of rotations of each of the branch gears is expressed by $94/67\times1.644$ (rps)$\approx2.307$ (rps). Therefore, a cycle G of each of the branch gears 30 is expressed by $1/2.307\approx0.434$ (sec).

The distance L between the two colors is set to 53.74 mm, and the processing speed is set to 123.99 mm/s. Therefore, a time interval between the two colors is expressed by $L/v=53.74/123.99\approx0.433$ (sec). In this color image forming apparatus, the cycle G is set so as to satisfy $G\approx L/v$. In other words, with setting of $L/v=n\times G$ (n: integer number), rotational speed fluctuations of each of the branch gears 30 are canceled in the distance L between the two colors. In this way, the color misregistration is reduced.

However, the two branch gears 30*a* and 30*b*, which are commonly and identically molded, have meshing angles respectively set between idler gears 31*a* and 31*b* and the drive gears 18Y and 18C so as to be different angles of 148.5° and 246.4°. In addition, the commonly and identically molded idler gears 31 (31*a* and 31*b*) have meshing angles respectively set between a transmission gear 32 and the branch gears 30 so as to be different angles of 125.3° and 142.1°.

Therefore, between the drive gears 18Y and 18C (and drive gears 18M and 18K) to which drive is respectively transmitted from the transmission gear 32, the rotational speed fluctuations of each of the branch gears 30 and rotational speed fluctuations of each of the idler gears 31 cannot be matched with each other. As a result, the color misregistration occurs between the photosensitive drums 1Y and 1C (and 1M and 1K) of the two colors.

FIG. 8A is a graph illustrating the rotational speed fluctuations of the branch gear 30*a* arranged on an upstream side in a sheet moving direction. FIG. 8B is a graph illustrating the rotational speed fluctuations of the branch gear 30*b* arranged on a downstream side in the sheet moving direction. FIGS. 9A and 9B are graphs each illustrating comparison between the rotational speed fluctuations of each of the branch gear 30*a* and the branch gear 30*b*. With reference to FIGS. 8A, 8B, 9A, and 9B, the mechanism of occurrence of the color misregistration is described.

Rotational speed fluctuations 34 (34*a* and 34*b*) at meshing positions between the branch gears 30 (30*a* and 30*b*) and the idler gears 31 (31*a* and 31*b*), in other words, at the time of drive input are indicated by broken lines. Rotational speed fluctuations 35 (35*a* and 35*b*) at meshing positions between the branch gears 30 (30*a* and 30*b*) and the drive gears 18Y and 18C on the upstream side in the transfer direction, in other words, at the time of drive output are indicated by dashed lines. It has been generally known that the rotational speed fluctuations of gears are caused as shown in FIGS. 8A, 8B, 9A, and 9B in one rotation cycle due to, for example, decentering of the gears.

In FIG. 8A, in a case where drive is input from the idler gear 31*a* when rotating the branch gear 30*a* on the upstream side in the transfer direction, which transmits drive to the drive gears 18Y and 18M on the upstream side in the transfer direction, at a maximum rotational speed, the rotational speed at a position rotated by 180° from the meshing position between the branch gear 30*a* and the idler gear 31*a* is a maximum rotational speed at the time of drive output. Thus, in the branch gear 30*a* that is rotated by 148.5° to mesh with the drive gear 18Y on the upstream side in the transfer direction, the peak of the rotational speed in the rotational speed fluctuation 35*a* at the time of drive output leads by a time period corresponding to 180−148.5=31.5(°) with respect to that of the rotational speed fluctuation 34*a* at the time of drive input.

Thus, a net rotational speed fluctuation of the branch gear 30*a* on the upstream side in the transfer direction is equal to a sum of the rotational speed fluctuation 34*a* at the time of drive input and the rotational speed fluctuation 35*a* at the time of drive output. As a result, a rotational speed fluctuation 36*a* as indicated by a solid line in FIG. 8A is obtained.

Similarly, in FIG. 8B, in a case where the branch gear 30*b* on the downstream side in the transfer direction, which transmits drive to the drive gears 18C and 18K on the downstream side in the transfer direction, meshes with the idler gear 31*b* when rotating the branch gear 30*b* at a maximum rotational speed, the branch gear 30*b* meshes with the drive gear 18C after being rotated by 246.4°. Thus, the peak of the rotational speed in the rotational speed fluctuation 35*b* at the time of drive output lags by a time period corresponding to 246.4−180=66.4(°) with respect to that of the rotational speed fluctuation 34*b* at the time of drive input. As a result, a net rotational speed fluctuation of the branch gear 30*b* is obtained as a rotational speed fluctuation 36*b* indicated by a solid line in FIG. 8B.

In a state of FIG. 9A, a meshing phase of the branch gear 30*a* on the upstream side in the transfer direction and a meshing phase of the branch gear 30*b* on the downstream side in the transfer direction are matched with each other so as to match the rotational speed fluctuations with each other. Even in this case, as shown in FIG. 9B, the rotational speed fluctuations 36*a* and 36*b* of the branch gears 30*a* and 30*b* cannot be perfectly matched with each other. As a result, color misregistration occurs by a distance corresponding to a difference Δ in rotational speed.

In addition, the idler gears 31 (31*a* and 31*b*) also have different meshing angles respectively set between the transmission gear 32 and the branch gears 30*a* and 30*b*. In FIG. 7, the meshing angle of the idler gear 31*a* on the upstream side in the transfer direction is 125.3°, and the meshing angle of the idler gear 31*b* on the downstream side in the transfer direction is 142.1°. In this case, color misregistration occurs in a manner similar to that of the two branch gears 30*a* and 30*b*.

SUMMARY OF THE INVENTION

The present invention provides an image forming apparatus capable of optimizing all meshing angles of idler gears between drive gears and a transmission gear so as to suppress color misregistration.

Further, the present invention provides an image forming apparatus described below.

According to one embodiment of the present invention, there is provided an image forming apparatus, including: a first photosensitive drum; a second photosensitive drum; a first drive portion which transmits a drive force to the first photosensitive drum, the first drive portion which has a transmission gear rotated by the drive force, an idler gear rotated in mesh with the transmission gear, and a drive gear rotated in mesh with the idler gear; and a second drive portion which transmits a drive force to the second photosensitive drum, the second drive portion which has a transmission gear rotated by the drive force, an idler gear rotated in mesh with the transmission gear, and a drive gear rotated in mesh with the idler gear, wherein the transmission gear of the first drive portion and the transmission gear of the second drive portion have the same shape, the idler gear of the first drive portion and the idler gear of the second drive portion have the same shape, and the drive gear of the first drive portion and the drive gear of the second drive portion have the same shape, wherein the first photosensitive drum is exposed to form a latent image and the latent image is formed into a first toner image through visualization with toner, the second photosensitive drum is exposed to form a latent image and the latent image is formed into a second toner image through visualization with toner, and the first toner image and the second toner image are transferred respectively from the first photosensitive drum and the second photosensitive drum onto a moving transfer member and superimposed to form an image, wherein the first photosensitive drum transfers the first toner image onto the transfer member at a first position, and the second photosensitive drum transfers the second toner image onto the transfer member at a second position that is downstream from the first position in a transfer member moving direction, wherein a time period from when the first photosensitive drum is exposed to form the latent image to when the first toner image is transferred onto the transfer member at the first position is substantially equal to a time period from when the second photosensitive drum is exposed to form the latent image to when the second toner image is transferred onto the transfer member at the second position, wherein the first drive portion and the second drive portion are arranged in a manner that a time period in which the transfer member moves from the first position to the second position is substantially equal to an integral multiple of a drive cycle of each of the idler gears, and wherein, when a meshing angle of the idler gear is an angle from a meshing position between the idler gear and the transmission gear to a meshing position between the idler gear and the drive gear with respect to a rotation center of the idler gear, the meshing angle of the idler gear of the first drive portion and the meshing angle of the idler gear of the second drive portion are substantially equal to each other, and a rotational phase of the idler gear of the first drive portion and a rotational phase of the idler gear of the second drive portion substantially match with each other.

Further, according to one embodiment of the present invention, there is provided an image forming apparatus, including: a first photosensitive drum; a second photosensitive drum; a single drive source; a first drive portion which has an idler gear rotated by receiving a drive force from the drive source to transmit the drive force to the first photosensitive drum; and a second drive portion which has an idler gear rotated by receiving a drive force from the drive source to transmit the drive force to the second photosensitive drum, wherein the idler gear of the first drive portion and the idler gear of the second drive portion have the same shape, wherein the first photosensitive drum is exposed to form a latent image and the latent image is formed into a first toner image through visualization with toner, the second photosensitive drum is exposed to form a latent image and the latent image is formed into a second toner image through visualization with toner, and the first toner image and the second toner image are respectively transferred from the first photosensitive drum and the second photosensitive drum onto a moving transfer member and superimposed to form an image, wherein the first photosensitive drum transfers the first toner image onto the transfer member at a first position, and the second photosensitive drum transfers the second toner image onto the transfer member at a second position that is downstream from the first position in a transfer member moving direction, wherein a time period from when the first photosensitive drum is exposed to form the latent image to when the first toner image is transferred onto the transfer member at the first position is substantially equal to a time period from when the second photosensitive drum is exposed to form the latent image to when the second toner image is transferred onto the transfer member at the second position, wherein the first drive portion and the second drive portion are arranged in a manner that a time period in which the transfer member moves from the first position to the second position is substantially equal to an integral multiple of a drive cycle of each of the idler gears, wherein, when a meshing angle of the idler gear is an angle from a meshing position between the idler gear and a gear arranged upstream from the idler gear to a meshing position between the idler gear and a gear arranged downstream from the idler gear with respect to a rotation center of the idler gear, the meshing angle of the idler gear of the first drive portion is θk, and the meshing angle of the idler gear of the second drive portion is substantially equal to (360°−θk), and wherein a rotational phase of the idler gear of the second drive portion leads by an angle substantially equal to (180°−θk) with respect to a rotational phase of the idler gear of the first drive portion.

Further features of the present invention will become apparent from the following description of exemplary embodiments with reference to the attached drawings.

DESCRIPTION OF THE EMBODIMENTS

In the following, with reference to the drawings, exemplary embodiments of the present invention are described in detail. Note that, dimensions, materials, shapes, relative positions thereof, and the like of components described in the embodiments are appropriately changed depending on a structure of an apparatus to which the present invention is applied, or depending on various other conditions. Thus, unless those factors are specifically described, the scope of the present invention is not limited only to those described in the embodiments.

In the following description, an upstream side in a transfer direction and a downstream side in the transfer direction may also be simply referred to as "upstream side" and "downstream side," respectively.

First Embodiment

Figure 1:
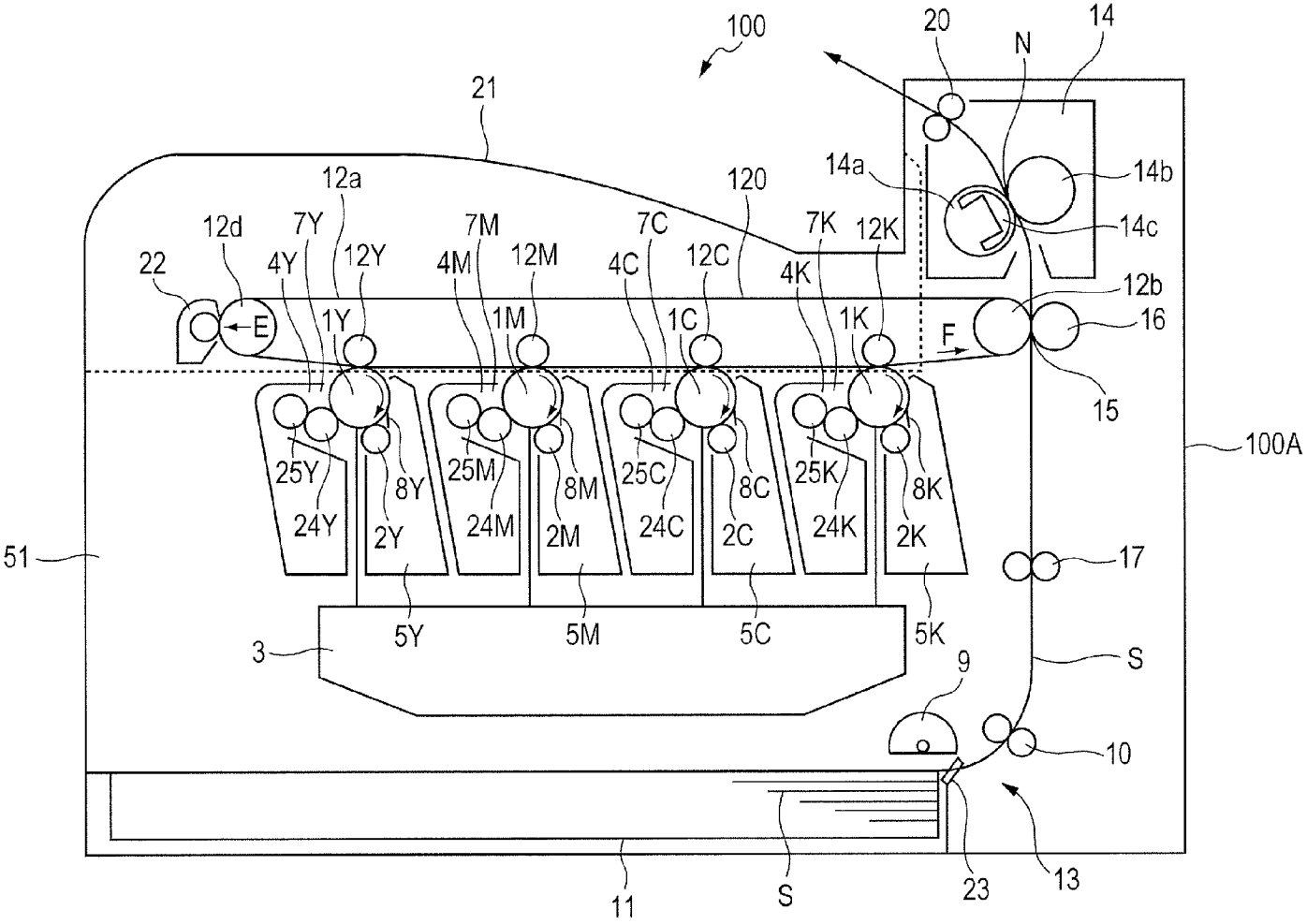
FIG. 1 is a sectional view of a configuration of an image forming apparatus including a drive transmission device according to a first embodiment of the present invention.

FIG. 1 is a sectional view of a configuration of an image forming apparatus 100 including a drive transmission device according to a first embodiment of the present invention. The image forming apparatus 100 is a color laser printer as a tandem type color image forming apparatus that utilizes an electrophotographic image forming process. As illustrated in FIG. 1, the image forming apparatus 100 includes an image forming apparatus main body (hereinafter simply referred to as "apparatus main body") 100A, and an image forming portion 51 for forming images is provided inside the apparatus main body 100A. The image forming portion 51 includes photosensitive drums 1 as "image bearing members," and primary transfer rollers 12 as "transfer devices." At least the photosensitive drums 1 are contained in cartridges 7, and incorporated into the apparatus main body 100A through the cartridges 7.

The image forming apparatus 100 includes four photosensitive drums 1 (1Y, 1M, 1C, and 1K). Around the photosensitive drums 1, along rotation directions thereof, charging devices 2 (2Y, 2M, 2C, and 2K), an exposure device 3, and developing devices 4 (4Y, 4M, 4C, and 4K) are sequentially arranged. The charging devices 2 (2Y to 2K) uniformly charge surfaces of the photosensitive drums 1. The exposure device 3 radiates laser beams based on image information so as to form electrostatic images on the photosensitive drums 1. The developing devices 4 (4Y to 4K) cause toner to adhere on the electrostatic images so as to visualize the electrostatic images as toner images.

Around the photosensitive drums 1, on a downstream side in rotation directions of the developing devices 4, the primary transfer rollers 12 (12Y, 12M, 12C, and 12K) and cleaning devices 8 (8Y, 8M, 8C, and 8K) are arranged. The primary transfer rollers 12 (12Y to 12K) transfer the toner images on the photosensitive drums 1 to an intermediate transfer belt 12*a*. The cleaning devices 8 (8Y to 8K) remove untransferred toner remaining on the surfaces of the photosensitive drums 1 after the transfer.

In this embodiment, the photosensitive drums 1 (1Y to 1K), the charging devices 2 (2Y to 2K), the developing devices 4 (4Y to 4K), and the cleaning devices 8 (8Y to 8K) are integrated into the cartridges. Those cartridges serve as process cartridges (hereinafter, referred to as "cartridges 7 (7Y to 7K)"), and are removably mounted to the apparatus main body 100A.

The four cartridges 7Y, 7M, 7C, and 7K have the same structure, but are different from each other in forming images of toners of different colors, specifically, yellow (Y), magenta (M), cyan (C), and black (K). The cartridges 7Y, 7M, 7C, and 7K respectively include the developing units 4Y, 4M, 4C, and 4K, and cleaner units 5Y, 5M, 5C, and 5K.

The developing units 4Y, 4M, 4C, and 4K respectively include developing rollers 24Y, 24M, 24C, and 24K, developer applying rollers 25Y, 25M, 25C, and 25K, and toner containers. The cleaner units 5Y, 5M, 5C, and 5K respectively include the photosensitive drums 1Y, 1M, 1C, and 1K, the charging rollers 2Y, 2M, 2C, and 2K, the cleaning blade 8Y, 8M, 8C, and 8K, and waste toner containers.

The photosensitive drums 1Y, 1M, 1C, and 1K are each obtained by applying an organic photoconductor layer (OPC) to an outer peripheral surface of an aluminum cylinder. Both end portions of each of the photosensitive drums 1Y, 1M, 1C, and 1K are rotatably supported by flanges. A drive force is transmitted from a drive motor (not shown) to each of the end portions on one side so as to rotationally drive the photosensitive drums 1Y, 1M, 1C, and 1K in the clockwise direction indicated by the arrows in FIG. 1. The charging devices (2Y to 2K) are conductive rollers each formed in a roller shape. The rollers are brought into abutment against the surfaces of the photosensitive drums 1Y to 1K, and charging bias voltages are applied thereto from a power source (not shown). In this way, the surfaces of the photosensitive drums 1 are uniformly charged.

The exposure device 3 is arranged vertically below the cartridges 7Y to 7K, and performs exposure on the photosensitive drums 1Y to 1K based on image signals. The developing units 4Y to 4K are adjacent respectively to toner containing portions containing the toners of the colors of yellow (Y), magenta (M), cyan (C), and black (K), and to the surfaces of the photosensitive members, and rotationally driven by drive portions (not shown). The developing units 4Y to 4K each include the developing roller that performs development by applying a developing bias voltage from a developing-bias power source (not shown).

With the configuration described above, the photosensitive drums 1Y to 1K are charged at a predetermined negative potential respectively by the charging rollers 2Y to 2K. Then, the electrostatic images are formed by the exposure device 3. Toners of negative polarity adhere to the electrostatic images through reverse development by the developing units 4Y to 4K. In this way, toner images of the colors Y, M, C, and K are formed.

An intermediate transfer belt unit 120 includes the intermediate transfer belt 12*a* stretched around a drive roller 12*b* and a tension roller 12*d*, and the tension roller 12*d* applies tension in a direction of the arrow E. The primary transfer rollers 12Y, 12M, 12C, and 12K are arranged on an inside of the intermediate transfer belt 12*a* so as to face the photosensitive drums 1Y, 1M, 1C, and 1K, and a transfer bias is applied from a bias applying unit (not shown).

The photosensitive drums 1Y to 1K are rotated in the direction of the arrows, and the intermediate transfer belt 12*a* is rotated in a direction of the arrow F. In addition, a bias of positive polarity is applied to the primary transfer rollers 12Y, 12M, 12C, and 12K. With this, sequentially from the toner image on the photosensitive drum 1Y, the toner images formed on the photosensitive drums 1Y to 1K are primarily transferred onto the intermediate transfer belt 12*a*. In this way, the toner images of the four colors are superimposed on each other, and in this state, conveyed to a secondary transfer portion 15.

A feeding device 13 includes a feeding roller 9 for feeding sheets S from an inside of a cassette 11 that contains the sheets S, and a conveying roller pair 10 for conveying the fed sheets S. The cassette 11 can be pulled out in a front direction of the apparatus main body 100A in FIG. 1. A user pulls out and removes the cassette 11 from the apparatus main body 100A, and then sheets S are sets and the cassette 11 is inserted into the apparatus main body 100A to complete replenishment of the sheets.

The sheets S contained in the cassette 11 are brought into press contact with the feeding roller 9, separated one by one by a separation pad 23 (friction piece separating system) and conveyed. The sheet S conveyed from the feeding device 13 is conveyed to the secondary transfer portion 15 by a registration roller pair 17. Then, the toner images of the four colors on the intermediate transfer belt 12*a* are secondarily transferred onto the sheet S.

A fixing portion 14 as a fixing unit heats and pressurizes the image formed on the sheet S to fix the image. A cylindrical fixing belt 14*a* is guided by a belt guide member 14*c* to which a heating unit such as a heater is bonded. An elastic pressure roller 14*b* and the belt guide member 14*c* nip the fixing belt 14*a*, form a fixing nip portion N which has a predetermined width and generate a predetermined press contact force. The pressure roller 14*b* is rotationally driven by a drive unit (not shown), and the cylindrical fixing belt 14*a* is rotated along therewith. An internal heater (not shown) heats the fixing belt 14*a*.

A temperature of the fixing nip portion N rises to a predetermined temperature, and is controlled. In this state, the sheet S, on which the unfixed toner image is formed, is conveyed from the image forming portion. The sheet S is introduced between the fixing belt 14*a* and the pressure roller 14*b* of the fixing nip portion N with an image surface facing up, that is, facing a surface of the fixing belt. In the fixing nip portion N, the image surface is firmly contacted with an outer surface of the fixing belt 14*a*, and the sheet S is nipped and conveyed through the fixing nip portion N together with the fixing belt 14*a*.

In the process in which the sheet S is nipped and conveyed through the fixing nip portion N together with the fixing belt 14*a*, the unfixed toner images on the sheet S are fixed by being heated with the heat of the heater inside the fixing belt 14*a*. The sheet S having the toner images fixed thereon is delivered onto a delivery tray 21 by a delivery roller pair 20.

Meanwhile, after the transfer of the toner images, the residual toner on the surfaces of the photosensitive drums 1Y to 1K is removed by the cleaning blades 8Y to 8K. The removed toner is collected into the waste toner containers in the cleaner units 5Y to 5K. After the secondary transfer to the sheet S, residual toner on the intermediate transfer belt 12*a* is removed by a transfer belt cleaning device 22. The removed toner passes through a waste toner conveying path (not shown) so as to be collected into a waste toner collection container (not shown) arranged in an apparatus depth portion.

Figure 2:
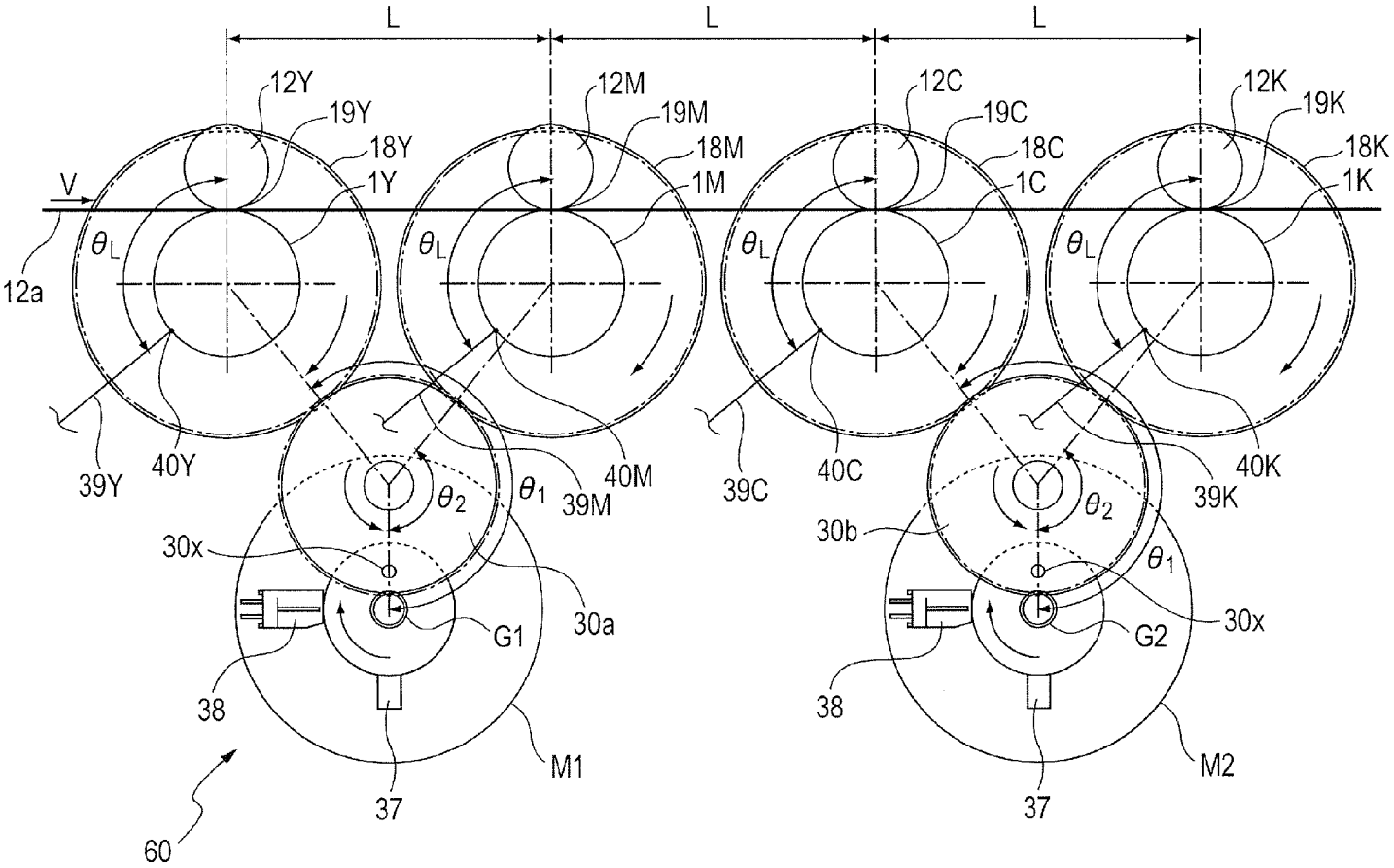
FIG. 2 is a sectional view of a configuration of primary transfer rollers, photosensitive drums, and the drive transmission device.

FIG. 2 is a sectional view of a configuration of the primary transfer rollers 12, the photosensitive drums 1, and a drive transmission device 60. Multiple drive gears 18 (18Y, 18M, 18C, and 18K) are provided coaxially and integrally with the photosensitive drums 1 in order to transmit the drive force to the photosensitive drums 1 (1Y, 1M, 1C, and 1K). Branch gears 30*a* and 30*b* serve as multiple "idler gears" for transmitting the drive force to the drive gears 18Y to 18K. Motors M (M1 and M2) rotate the photosensitive drums 1 (1Y, 1M, 1C, and 1K). Motor gears G (G1 and G2) are mounted integrally with rotary shafts of the motors as drive sources, and serve as "transmission gears" for transmitting the drive force to the branch gears 30 (30*a* and 30*b*). The motor gear G1, the branch gear 30*a*, and the drive gears 18Y and 18M serve as a first drive portion for transmitting the drive force to the photosensitive drums 1Y and 1M (first and third photosensitive drums). Further, the motor gear G2, the branch gear 30*b*, and the drive gears 18C and 18K serve as a second drive portion for transmitting the drive force to the photosensitive drums 1C and 1K (second and fourth photosensitive drums).

Nip is formed at transfer positions 19 (19Y, 19M, 19C, and 19K) by the primary transfer rollers 12 (12Y, 12M, 12C, and 12K) arranged on a back side of the intermediate transfer belt 12*a* and the photosensitive drums 1 nipping and press contacting with each other. Laser beams 39 (39Y, 39M, 39C, and 39K) emitted from the exposure device (not shown) are illustrated, and exposure positions 40 (40Y, 40M, 40C, and 40K) on the photosensitive drums 1 (1Y, 1M, 1C, and 1K), to which the laser beams emitted from the exposure device are radiated, are illustrated. In the following, the rotation of the photosensitive drums 1 and the rotation of a gear train are described.

A distance between the transfer positions 19Y and 19M, a distance between the transfer positions 19M and 19C, and a distance between the transfer positions 19C and 19K are each set to L (mm). The intermediate transfer belt 12*a* is rotated at a speed v (mm/s). In this embodiment, the photosensitive drums 1 (1Y to 1K) are each rotated at a peripheral speed that is equal to the speed of the transfer belt. The two branch gears 30*a* and 30*b* are rotated at a speed of the same cycle G (sec), and have the same shape formed by identical molding or identical processing.

As well as the two branch gears 30*a* and 30*b*, the two motor gears G1 and G2 have the same shape formed by identical molding or identical processing. The motor gears G1 and G2 are rotated in the same phase and at the same speed with use of phase detection flags 37 and phase detection sensors 38 provided integrally therewith. Thus, rotational speed fluctuation phases and rotational speed fluctuation amounts are equalized to each other.

The two branch gears 30 mesh with the drive gears 18Y and 18C on the upstream side in the transfer direction while being driven respectively by the two motor gears G (G1 and G2) at the same meshing angle $\theta_1$(°) (angle in the rotation direction). Further, the branch gears 30 are assembled in the same meshing phase with respect to the motor gears G1 and G2 (with reference to phase alignment marks 30*x*). Thus, when the motor gears G1 and G2 are rotated in the same phase and at the same speed, the two branch gears 30 are rotationally driven in the same phase at the same timing.

This configuration can be also described as follows. In a case that meshing positions of the branch gears 30*a*, 30*b* for the motor gears G1, G2 as "input side gears" rotate to meshing positions of the branch gears 30*a*, 30*b* for the drive gears 18 as "output side gears" along pitch circles of the branch gears 30*a* and 30*b*, meshing angles are "θj," specifically, $\theta_1$ and $\theta_2$. In still other words, a meshing angle of a gear (in this case, branch gear 30) is defined as an angle from a meshing position between the gear and a gear on the upstream side thereof to a meshing position between the gear and a gear on the downstream side thereof with respect to a rotation center of the gear. In this case, the meshing angles $\theta_1$ and $\theta_2$ of each of the multiple branch gears 30*a* and 30*b* are substantially equal to each other. Further, the meshing phase of the branch gear 30*b* on the downstream side is substantially identical with the meshing phase of the branch gear 30*a* on the upstream side.

A time period in which the intermediate transfer belt (transfer member) 12*a* moves in a transfer interval between the transfer positions 19Y and 19M of two colors, to which drive is transmitted from the branch gear 30*a*, is set to be equal to a time period in which the branch gear 30*a* rotates "n" times. Similarly, with regard to the branch gear 30*b*, a time period in which the intermediate transfer belt 12*a* moves in a transfer interval between the transfer positions 19C and 19K of two colors, to which drive is transmitted from the branch gear 30*b*, is set to be equal to a time period in which the branch gear 30*b* rotates "n" times.

That is, the distance L between the transfer positions, the transfer belt speed v, the cycle G of each of the branch gears 30 (30*a* and 30*b*) are set so as to satisfy the relationship expressed by the following expression.

(Expression 1)

$$L/v = n \times G \text{ (}n\text{: integer number)} \quad (1.1)$$

This setting can be also described as follows. When the transfer member 12*a* is moved from the upstream side to the downstream side in a transfer member moving direction V, the transfer positions of the photosensitive drums 1Y and 1C on the upstream side are referred to as the first positions 19Y and 19C, and the transfer positions of the photosensitive drums 1M and 1K on the downstream side with respect thereto are referred to as the second positions 19M and 19K. When the transfer member 12*a* passes through the first positions 19Y and 19C in the transfer member moving direction V, a timing at which developer images on the photosensitive drums 1Y and 1C on the upstream side are transferred onto the transfer member 12*a* is referred to as a first transfer timing. When the transfer member 12*a* passes through the second positions 19M and 19K in the transfer member moving direction V, a timing at which developer images on the photosensitive drums 1M and 1K on the downstream side are transferred onto the transfer member 12*a* is referred to as a second transfer timing. With this, in the drive transmission device 60, a time period from the first transfer timing to the second transfer timing is substantially equal to an integral multiple of the drive cycle of each of the branch gears 30*a* and 30*b*.

With this gear setting, rotational speed fluctuations of the branch gears 30 (30*a* and 30*b*) can be cancelled in the interval of L mm between the transfer positions of two colors (the meaning of which is "synchronized and matched in phase," hereinafter the same).

In this embodiment, angles $\theta_L$ between the four exposure positions 40 (40Y to 40K) on the photosensitive drums 1 (1Y to 1K) of the laser beams 39 (39Y to 39K) emitted from the exposure device 3 and the four transfer positions 19 (19Y to 19K) are set to be equal to each other. Rotational speeds of the four photosensitive drums 1 (1Y to 1K) are also set to be equal to each other.

This setting can be also described as follows. When the transfer member 12*a* passes through the first positions 19Y and 19C in the transfer member moving direction V, a timing at which the photosensitive drums 1Y and 1C on the upstream side are exposed with light is referred to as a first exposure timing. When the transfer member 12*a* passes through the second positions 19M and 19K in the transfer member moving direction V, a timing at which the photosensitive drums 1M and 1K on the downstream side are exposed with light is referred to as a second exposure timing. With this, in the drive transmission device 60, a time period from the first exposure timing to the second exposure timing is substantially equal to an integral multiple of the drive cycle of each of the branch gears 30*a* and 30*b*. In other words, a time period from when the photosensitive drums 1Y and 1C are exposed with light to form the latent images to when the toner images formed through visualization of the latent images are transferred onto the transfer member 12*a* at the first positions 19Y and 19C is substantially equal to a time period from when the photosensitive drums 1M and 1K are exposed with light to form the latent images to when the toner images formed through visualization of the latent images are transferred onto the transfer member 12*a* at the second positions 19M and 19K.

Thus, as in the description of the interval between the transfer positions, with this gear setting, the rotational speed fluctuations of the branch gears 30 (30*a* and 30*b*) can be cancelled in exposure times periods between the two colors (between Y and C, and between M and K). Here, specific values for detailed description are listed in Table 1.

TABLE 1

| | |
|---|---|
| Distance L (mm) between transfer positions | 54.54 |
| Processing speed (mm/s) | 123.99 |
| Number of teeth of branch gear 30 | 68 |
| Number of teeth of motor gear G | 17 |
| Number of rotations of motor (rpm) | 545.57 |

The distance L between the transfer positions is set to 54.54 mm, and the processing speed is set to 123.99 mm/s.

Therefore, a time period L/v between the transfer positions is expressed the following Expression 2.

(Expression 2)

$$L/v=54.54/123.990.440 \text{ (sec)} \quad (2)$$

Similarly, as described above, the exposure time periods of the two colors are each equal to the time period between the transfer positions, that is, 0.440 (sec).

The number of rotations of the motor is 545.57 (rpm). As expressed by the following Expression 3, the number of rotations of the branch gear 30 is obtained based on the number of teeth of each of the motor gear G and the branch gear 30.

(Expression 3)

$$545.57 \text{ (rpm)}\times 17/68\approx 136.39 \text{ (rpm)}\times 2.273 \text{ (rps)} \quad (3)$$

With use of this value, the cycle G of the branch gear 30 is obtained as expressed by the following Expression 4.

(Expression 4)

$$G=1/2.273\approx 0.440 \text{ (sec)} \quad (4)$$

With use of this value and the Expressions 1 and 2, the number of rotations n of the branch gear 30 is obtained as expressed by the following Expression 5.

(Expression 5)

$$n=(L/v)/G=0.440/0.440=1 \quad (5)$$

In this embodiment, a time period in which the intermediate transfer belt 12*a* is moved in each of the interval between the transfer positions 19Y and 19M of the two colors and the interval between the transfer positions 19C and 19K of the two colors, to which drive is transmitted from the branch gears 30 (30*a* and 30*b*), is set to be equal to a time period of one rotation of the respective branch gears 30 (30*a* and 30*b*). Similarly, an exposure interval between the two colors Y and M and an exposure interval between the two colors C and K are each set to be equal to the time period of one rotation of the respective branch gears 30 (30*a* and 30*b*).

As described above, the branch gears 30 (30*a* and 30*b*) are each an idler gear. The branch gear 30*a* branches the drive force to the drive gears 18Y and 18M for driving the photosensitive drums 1Y and 1M. The branch gear 30*b* branches the drive force to the drive gears 18C and 18K for driving the photosensitive drums 1C and 1K.

Figure 3A:
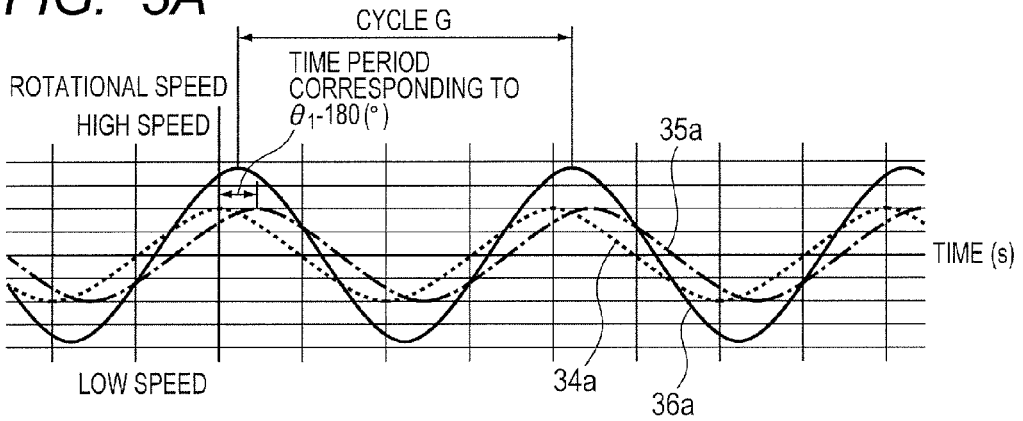
FIG. 3A is a graph illustrating rotational speed fluctuations of a branch gear on an upstream side in a transfer direction.
Figure 3B:
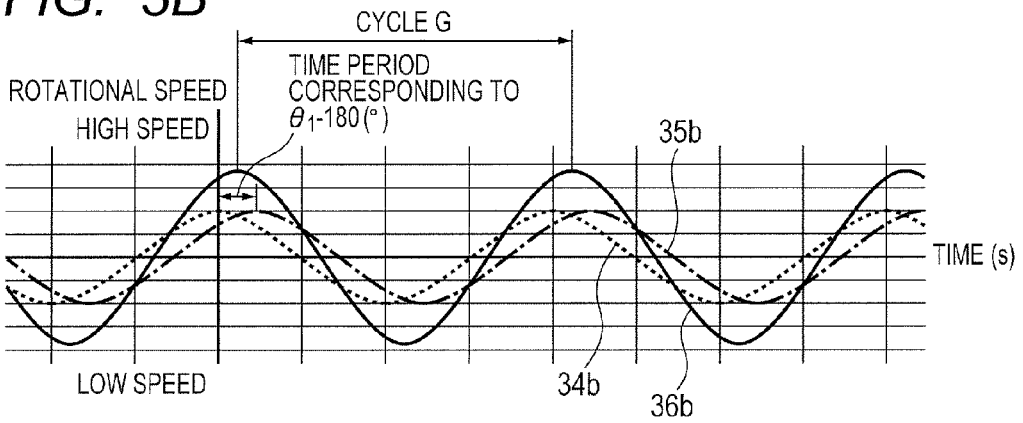
FIG. 3B is a graph illustrating rotational speed fluctuations of a branch gear on a downstream side in the transfer direction.
Figure 3C:
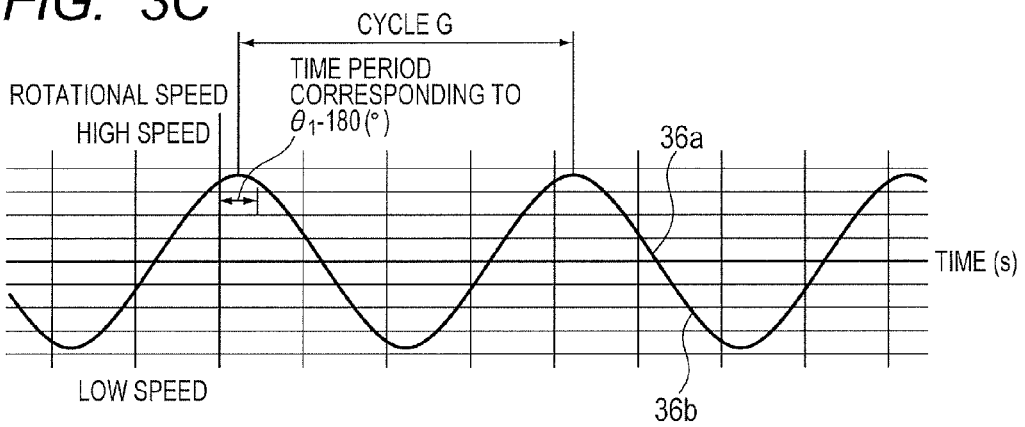
FIG. 3C is a graph illustrating the rotational speed fluctuations of the branch gears on the upstream side in the transfer direction and on the downstream side in the transfer direction.

FIG. 3A is a graph illustrating the rotational speed fluctuations of the branch gear 30*a* on the upstream side for transmitting the drive force to the photosensitive drums 1Y and 1M on the upstream side in the transfer direction. FIG. 3B is a graph illustrating the rotational speed fluctuations of the branch gear 30*b* on the downstream side for transmitting the drive force to the photosensitive drums 1C and 1K on the downstream side in the transfer direction. FIG. 3C is a graph illustrating comparison between the rotational speed fluctuations of each of the two branch gears 30*a* and 30*b*. In the following, with reference to FIGS. 3A to 3C, the meshing angles of the branch gears 30 (30*a* and 30*b*), which are the most characteristic feature of the present invention, are described.

The broken lines in the graphs of FIGS. 3A and 3B indicate rotational speed fluctuations 34 (34*a* and 34*b*) at the meshing positions between the branch gears 30 (30*a* and 30*b*) and the motor gears G (G1 and G2), in other words, at the time of drive input. The dashed lines in the graphs of FIGS. 3A and 3B indicate rotational speed fluctuations 35 (35*a* and 35*b*) at the meshing positions between the branch gears 30 (30*a* and 30*b*) and the drive gears 18Y and 18C on the upstream side in the transfer direction, in other words, at the time of drive output. It has been generally known that the rotational speed fluctuations of gears are caused as shown in FIGS. 3A and 3B in the one rotation cycle G due to, for example, decentering of rotary shafts.

The mechanism of occurrence of the rotational speed fluctuations of gears due to the decentering of rotary shafts is briefly described. When a rotary shaft of the gear swing to displace from a center during a rotation of the gear, a long part and a short part occur as to a dimension from the center to a surface of the gear. In such a case, the long part in dimension from the center to the surface of the gear is rotated at low speed, and the short part in dimension from the center to the surface of the gear is rotated at high speed. Such phenomenon is referred to as the rotational speed fluctuation.

In FIG. 3A, when drive is input from the motor gear G1 in a case that the speed fluctuation of the branch gear 30*a* on the upstream side in the transfer direction is at a peak, the rotational speed fluctuation at the time of drive output has a peak at a position rotated by 180° from the meshing position between the branch gear 30*a* and the motor gear G1. Thus, at the meshing position between the branch gear 30*a* that has been rotated by $\theta_1$(°) (in this embodiment, 219.2°) and the drive gear 18Y, a peak of the rotational speed fluctuation 35*a* at the time of drive output lags by a time period corresponding to $\theta_1$−180(°) (lags by a time period corresponding to 219.2−180=39.2°) with respect to a peak of the rotational speed fluctuation 34*a* at the time of drive input.

Thus, a net rotational speed fluctuation of the branch gear 30*a* on the upstream side is equal to a sum of the rotational speed fluctuation 34*a* at the time of drive input and the rotational speed fluctuation 35*a* at the time of drive output. As a result, the net rotational speed fluctuation is a rotational speed fluctuation 36*a* indicated by a solid line in FIG. 3A.

Similarly, the branch gear 30*a* is assembled in a manner that, as shown in FIG. 3B, the meshing phase between the branch gear 30*b* on the downstream side in the transfer direction and the motor gear G2 matches with the meshing phase between the branch gear 30*a* on the upstream side in the transfer direction and the motor gear G1. Thus, drive from the motor gear G2 is input at a peak of a rotational speed fluctuation.

In addition, the meshing angle of the branch gear 30*b* is set to be equal to the meshing angle of the branch gear 30*a* on the upstream side, that is, $\theta_1$(°). Thus, a peak of the rotational speed fluctuation 35*b* at the time of drive output lags by a time period corresponding to $\theta_1$−180(°) with respect to the rotational speed fluctuation 34*b* at the time of drive input. As a result, a net rotational speed fluctuation of the branch gear 30*b* is a rotational speed fluctuation 36*b* indicated by a solid line in FIG. 3B.

In this way, the meshing angles of the two branch gears 30 (30*a* and 30*b*) are set to be equal to each other, and the branch gears 30 (30*a* and 30*b*) are assembled so as to mesh in the same phase. With this, as shown in FIG. 3C, rotational speed fluctuation phases and rotational speed fluctuation amounts of the two branch gears 30 are equalized to each other, and hence rotational speed fluctuations of the drive gears 18Y and 18C located on a downstream side in a driving direction thereof can be matched with each other. Thus, between the two colors Y and C, the respective rotational speed during the exposure can be matched with each other and the respective rotational speed during the transfer can be matched with each other. As a result, color misregistration between the two colors Y and C can be reduced.

Similarly, also with regard to the two colors M and K, the two branch gears 30 (30*a* and 30*b*) have the meshing angles from the motor gears G to the drive gears 18M and 18K, which are set to be equal to each other, that is, set to the angle $\theta_2$, to be assembled so as to mesh in the same phase. Thus, color misregistration between the two colors M and K can be reduced.

According to this embodiment, all the meshing angles of the idler gears between the drive gears and the transmission gears can be optimized. Thus, the color misregistration can be suppressed.

In this embodiment, although the color misregistration relevant to the drive transmission device in the image forming apparatus is described, there are other occurrence factors of the color misregistration. For example, the occurrence factors include accuracy of mounting positions such as the positions of the photosensitive drums 1Y to 1K of the four colors, the position of the exposure device 3, and the positions of the primary transfer rollers 12Y to 12K, errors in outer diameter and decentering of the drive roller, and accuracy in film thickness of the transfer belt. Moreover, the occurrence factors include dimensional accuracy such as errors in outer diameter and decentering of the photosensitive drums 1Y to 1K.

Thus, unless a maximum allowable amount of the color misregistration relative to the drive transmission device is suppressed to approximately ½ dots, that is, approximately 20 μm or less in an image resolution of 600 dpi, it is difficult to form high quality images with the image forming apparatus. In this embodiment, the two branch gears 30 (30*a* and 30*b*) are configured to have the meshing angles that are equal to each other, and assembled in the same meshing phase by matching the phases. With this, theoretical color misregistration relative to the drive transmission device is reduced as much as possible.

Thus, in this embodiment, between the corresponding two colors (in this embodiment, between Y and C, and between M and K), a range of the meshing angle, in which the maximum allowable amount of the color misregistration is suppressed to 20 μm, is ±31.8° when accuracy of the gears is equivalent to Level 2 conforming to the standard of JGMA. Thus, the advantage of the present invention can be obtained as long as the branch gear 30*b* on the downstream side in the transfer direction forms a meshing angle that falls within a range of from 187.4° to 251° with respect to an optimum meshing angle of 219.2° when the branch gear 30*a* on the upstream side in the transfer direction forms a meshing angle of 219.2°.

Similarly, between the corresponding two colors (in this embodiment, between Y and C. and between M and K), a range of the gear meshing phase, in which the maximum allowable amount of the color misregistration is suppressed to 20 μm, is ±16.7° when accuracy of the gears is equivalent to Level 2 conforming to the standard of JGMA. Thus, the advantage of the present invention can be obtained as long as the branch gear 30*b* on the downstream side in the transfer direction has a gear meshing phase that falls within a range of from −16.7° to 16.7° with respect to an optimum gear meshing phase of 0° relative to the gear meshing phase of the branch gear 30*a* on the upstream side in the transfer direction.

In accordance with changes in accuracy and number of teeth of the gear, the maximum allowable amount of the color misregistration between the two colors is suppressed to 20 μm at different angles. Thus, the scope of the present invention includes all the range in which the maximum allowable amount of the color misregistration between the two colors is suppressed to 20 μm in the drive transmission device as a whole.

Second Embodiment

Figure 4:
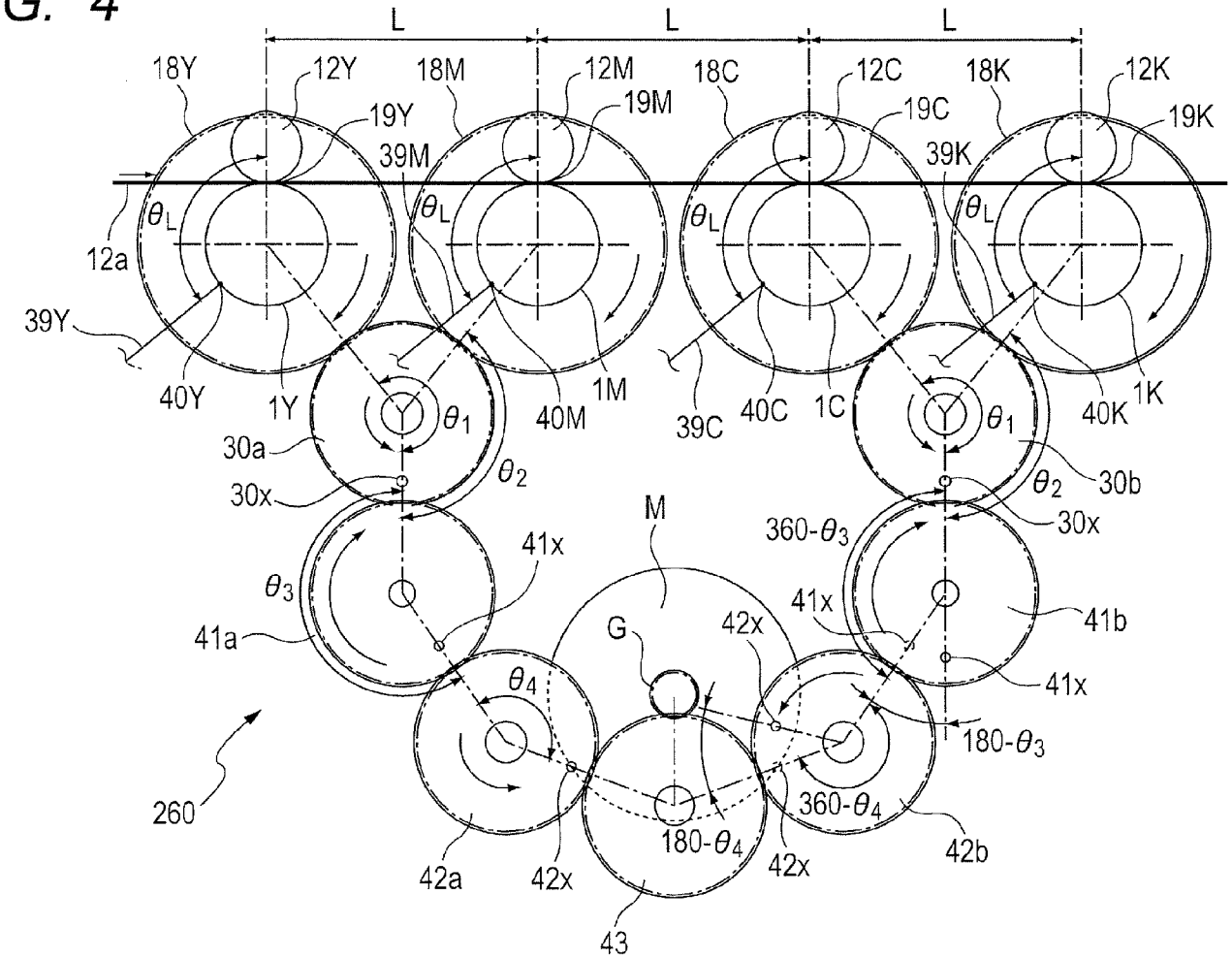
FIG. 4 is a sectional view of a configuration of primary transfer rollers, photosensitive drums, and a drive transmission device of an image forming apparatus according to a second embodiment of the present invention.
Figure 5A:
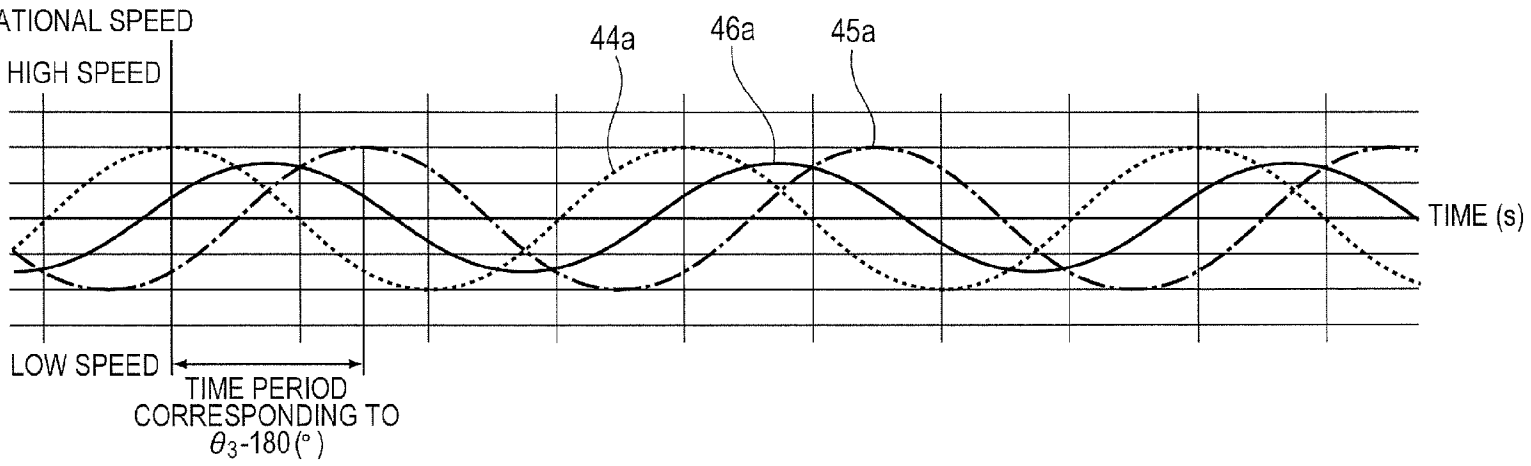
FIG. 5A is a graph illustrating rotational speed fluctuations of a right-under idler gear on the upstream side in the transfer direction.
Figure 5B:
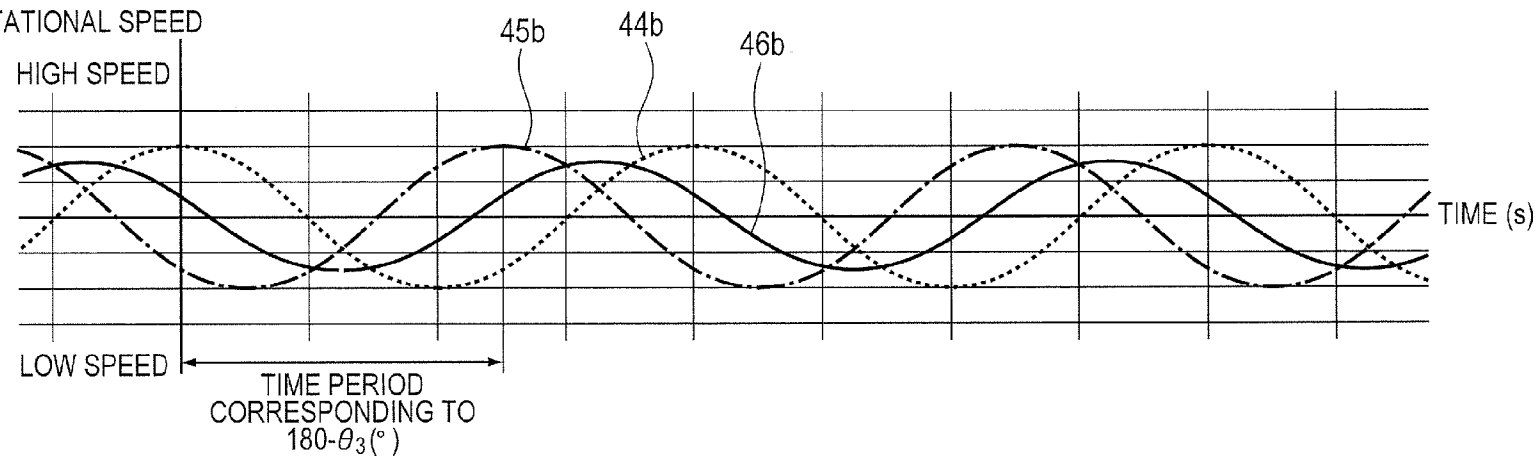
FIG. 5B is a graph illustrating rotational speed fluctuations of a right-under idler gear on the downstream side in the transfer direction.

FIG. 4 is a sectional view of a configuration of the primary transfer rollers 12, the photosensitive drums 1, a drive transmission device 260, and the primary transfer portion of an image forming apparatus according to a second embodiment of the present invention. The second embodiment is significantly different from the first embodiment in employing a drive transmission device of what is called a single motor system, that is, including one motor as the drive source. FIGS. 5A and 5B are graphs each illustrating rotational speed fluctuations of right-under idler gears 41 (41*a* and 41*b*).

The drive gears 18 (18Y, 18M, 18C, and 18K) are provided coaxially and integrally with the photosensitive drums 1 (1Y, 1M, 1C, and 1K) so as to transmit drive to the photosensitive drums 1. The motor M serves as a drive source, and the motor gear G is mounted integrally with the rotary shaft of the motor M. The right-under idler gears (41*a* and 41*b*) transmit drive to the branch gears 30 (30*a* and 30*b*). Obliquely under idler gears 42 (42*a* and 42*b*) transmit drive to the right-under idler gears 41 (41*a* and 41*b*). A transmission gear 43 inputs drive from the motor gear G to the two obliquely under idler gears 42 (42*a* and 42*b*). In this embodiment, the "multiple idler gears" are defined as the branch gears (third idler gears) 30*a* and 30*b*, the right-under idler gears (idler gears) 41*a* and 41*b*, and the obliquely under idler gears (second idler gears) 42*a* and 42*b* that are sequentially arrayed in a region from the transmission gear 43 side toward the drive gears 18Y to 18K.

The right-under idler gear 41*a*, the obliquely under idler gear 42*a*, the branch gear 30*a*, and the drive gears 18Y and 18M serve as a first drive portion for transmitting a drive force to the photosensitive drums 1Y and 1M (first and third photosensitive drums). The right-under idler gear 41*b*, the obliquely under idler gear 42*b*, the branch gear 30*b*, and the drive gears 18C and 18K serve as a second drive portion for transmitting a drive force to the photosensitive drums 1C and 1K (second and fourth photosensitive drums).

In this embodiment, the idler gears are qualified by the adjectives "right-under" and "obliquely under." Those adjectives are used only for the sake of convenience in representing that the gears 41 are located right under the branch gears 30, and the gears 42 are located obliquely under the gears 41.

At the transfer positions 19 (19Y, 19M, 19C, and 19K), the primary transfer rollers 12 (12Y, 12M, 12C, and 12K) arranged on the back side of the intermediate transfer belt 12*a* and the photosensitive drums 1 are held in press contact with each other to form the nips. The laser beams 39 (39Y, 39M, 39C, and 39K) is illustrated and emitted from the exposure device (not shown), and the exposure positions (40Y, 40M, 40C, and 40K) on the photosensitive drums 1 (1Y, 1M, 1C, and 1K), to which the laser beams emitted from the exposure device are radiated.

With regard to the rotation of the train of the gears in this embodiment, the common features between the first embodiment and the second embodiment are briefly described. In FIG. 4, the distance L between the transfer positions 19Y and 19M, the distance L between the transfer positions 19M and 19C, and the distance L between the transfer positions 19C and 19K are each set to 54.54 mm. The processing speed, that is, the speed v of the intermediate transfer belt 12*a* and the peripheral speed v of each of the photosensitive drums 1 (1Y to 1K) are each set to 123.99 (mm/s). Further, the cycle G of each of the two branch gears 30*a* and 30*b* is set so as to satisfy a relationship G≈0.440 (sec).

Then, the time period in which the intermediate transfer belt 12*a* passes through the distance L between the transfer positions is obtained as expressed by the following Expression 6.

(Expression 6)

$$L/v=54.54/123.99\approx0.440\ (\text{sec})1\times G \quad (6)$$

As in the first embodiment, while the intermediate transfer belt 12*a* passes through the distance L between the transfer positions, the two branch gears 30*a* and 30*b* each make substantially one rotation.

The two branch gears 30 (30*a* and 30*b*), the two right-under idler gears 41 (41*a* and 41*b*), the two obliquely under idler gears 42 (42*a* and 42*b*), and the four drive gears 18 (18Y to 18K) are the same as those in the first embodiment. Specifically, those gears have the same shape formed by identical molding or identical processing, and rotated at the same cycle and by the same eccentric amount.

The two branch gears 30 (30*a* and 30*b*) mesh with the drive gears 18Y and 18C on the upstream side in the transfer direction while being driven respectively by the two right-under idler gears 41 (41*a* and 41*b*) at substantially the same meshing angle $\theta_1$(°) (in this embodiment, $\theta_1$=219.2°). Similarly, the two branch gears 30 (30*a* and 30*b*) are arranged to mesh also with the drive gears 18M and 18K on the downstream side in the transfer direction at substantially the same meshing angle $\theta_2$(°) (in this embodiment, $\theta_2$=140.8°).

The two branch gears 30*a* and 30*b* are arranged substantially in the same phase with respect to meshing positions between the branch gears 30*a* and 30*b* and the two right-under idler gears 41*a* and 41*b* located on an upstream side in the driving direction (with reference to the phase alignment marks 30*x*). The four drive gears 18Y to 18K are assembled to be substantially in the same phase with each other by matching the phases when the intermediate transfer belt 12*a* reaches the respective transfer positions 19Y to 19K.

This configuration can be also described as follows. In a case that meshing positions of the branch gears 30*a*, 30*b* for the right-under idler gears 41*a* and 41*b* as "input side gears" rotate to meshing positions of the branch gears 30*a*, 30*b* for the drive gears 18 as "output side gears" along pitch circles of the branch gears 30*a* and 30*b*, meshing angles are $\theta_1$ and $\theta_2$. In this case, the meshing angles $\theta_1$ and $\theta_2$ of each of the multiple branch gears 30*a* and 30*b* are substantially equal to each other. Further, the meshing phase of the branch gear 30*b* on the downstream side substantially matches with the meshing phase of the branch gear 30*a* on the upstream side.

On the upstream side, the right-under idler gear 41*a* has a meshing angle $\theta_3$(°) set between the obliquely under idler gear 42*a* and the branch gear 30*a*. On the downstream side, the right-under idler gear 41*b* has a meshing angle that is substantially equal to 360−$\theta_3$(°) set between the obliquely under idler gear 42*b* and the branch gear 30*b*. The right-under idler gear 41*b* on the downstream side in the transfer direction is assembled in a phase forming an angle substantially equal to 180−$\theta_3$(°) with respect to a meshing phase between the right-under idler gear 41*a* on the upstream side in the transfer direction and the obliquely under idler gear 42*a*. In other words, the idler gear 41*b* is assembled in a manner that a rotational phase of the idler gear 41*b* leads by the angle substantially equal to 180−$\theta_3$(°) with respect to a rotational phase of the idler gear 41*a*.

On the upstream side, the obliquely under idler gear 42*a* has a meshing angle $\theta_4$(°) set between the right-under idler gear 41*a* and the transmission gear 43. On the downstream side, the obliquely under idler gear 42*b* has a meshing angle that is substantially equal to 360−$\theta_4$(°) set between the right-under idler gear 41*b* and the transmission gear 43. The obliquely under idler gear 42*b* on the downstream side in the transfer direction is assembled in a phase forming an angle substantially equal to 180−$\theta_4$(°) with respect to a meshing phase between the obliquely under idler gear 42*a* on the upstream side in the transfer direction and the transmission gear 43. In other words, the idler gear 42*b* is assembled in a manner that a rotational phase of the idler gear 42*b* leads by the angle substantially equal to 180−$\theta_4$(°) with respect to a rotational phase of the idler gear 42*a*.

This setting can be also described as follows. In a case that a meshing position of the right-under idler gear 41*a* for the input side gear rotates to a meshing position of the right-under idler gear 41*a* for the output side gear along pitch circle of the right-under idler gear 41*a* on the upstream side, the meshing angle is $\theta_3$. In this case, in a case that a meshing position of the right-under idler gear 41*b* for the input side gear rotates to a meshing position of the right-under idler gear 41*b* for the output side gear along pitch circle of the right-under idler gear 41*b* on the downstream side, the meshing angle is substantially equal to $360-\theta_3(°)$. A meshing phase of the right-under idler gear 41*b* on the downstream side leads by the angle substantially equal to $180-\theta_3(°)$ with respect to a meshing phase of the right-under idler gear 41*a* on the upstream side.

In a case that a meshing position of the obliquely under idler gear 42*a* for the input side gear rotates to a meshing position of the obliquely under idler gear 42*a* for the output side gear along pitch circle of the obliquely under idler gear 42*a* on the upstream side, the meshing angle is $\theta_4$. In this case, in a case that a meshing position of the obliquely under idler gear 42*b* for the input side gear rotates to a meshing position of the obliquely under idler gear 42*b* for the output side gear along pitch circle of the obliquely under idler gear 42*b* on the downstream side, the meshing angle substantially equal to $360-\theta_4(°)$. A meshing phase of the obliquely under idler gear 42*b* on the downstream side leads by the angle substantially equal to $180-\theta_4(°)$ with respect to a meshing phase of the obliquely under idler gear 42*a* on the upstream side.

Figure 6A:
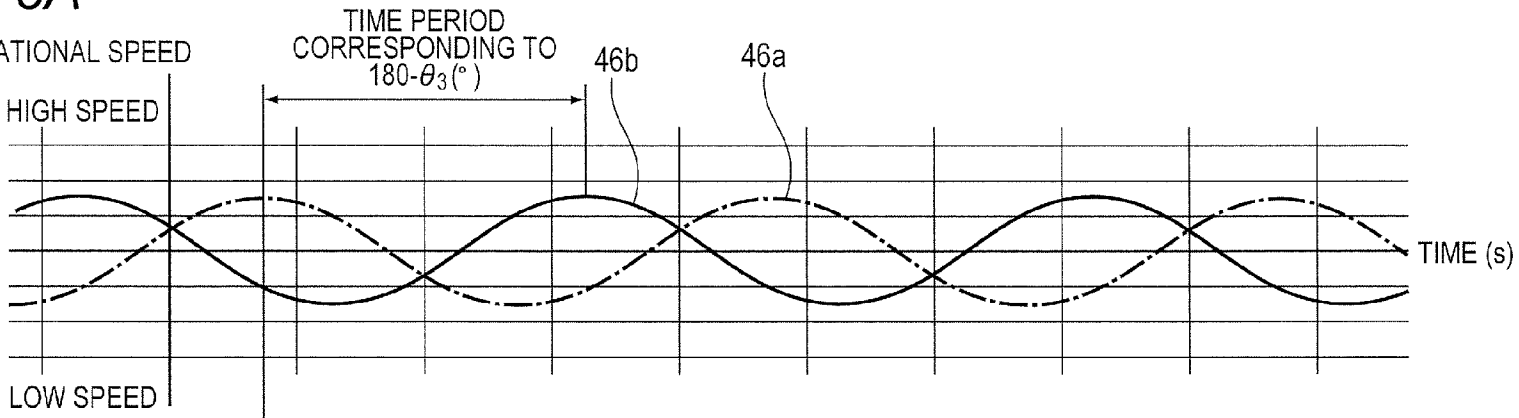
FIG. 6A is a graph illustrating comparison between the rotational speed fluctuations of each of the right-under idler gears on the upstream side in the transfer direction and the downstream side in the transfer direction.
Figure 6B:
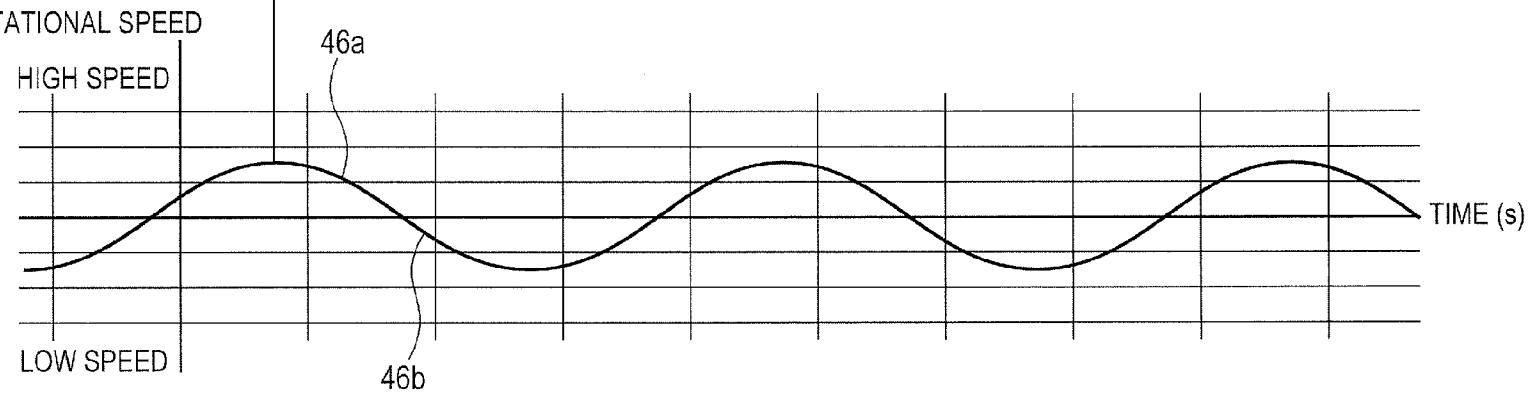
FIG. 6B is a graph illustrating the rotational speed fluctuations of each of the right-under idler gears on the upstream side in the transfer direction and on the downstream side in the transfer direction.
Figure 7:
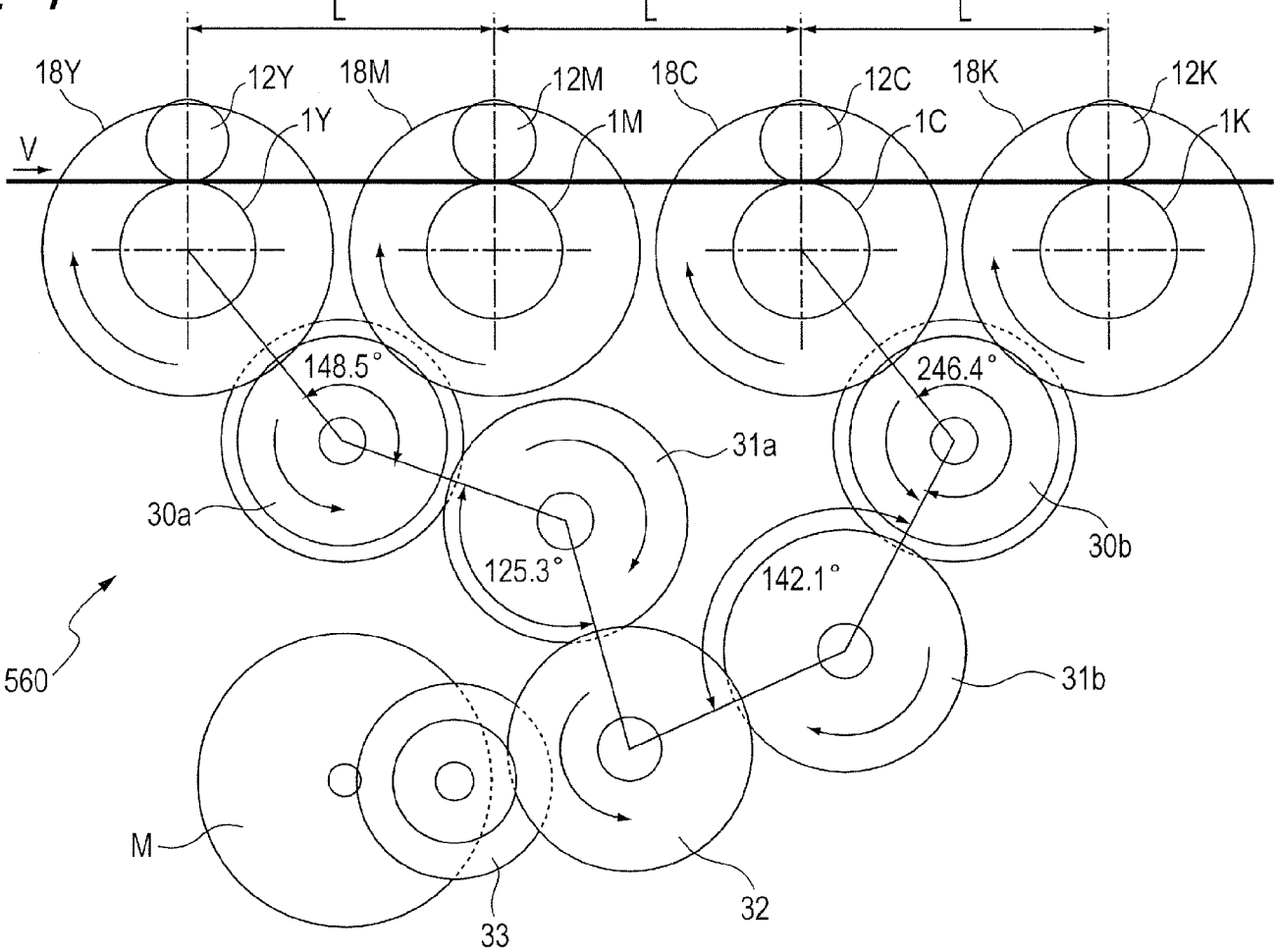
FIG. 7 is a sectional view of a configuration of primary transfer rollers, photosensitive drums, and a drive transmission device in an image forming apparatus of a related art.
Figure 8A:
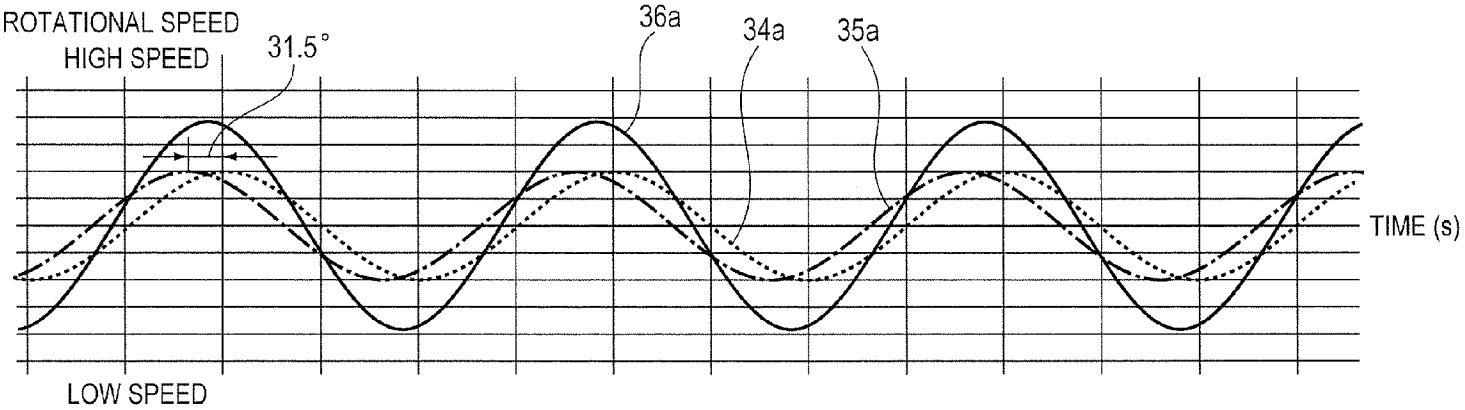
FIG. 8A is a graph illustrating rotational speed fluctuations of a branch gear on the upstream side in the transfer direction.
Figure 8B:
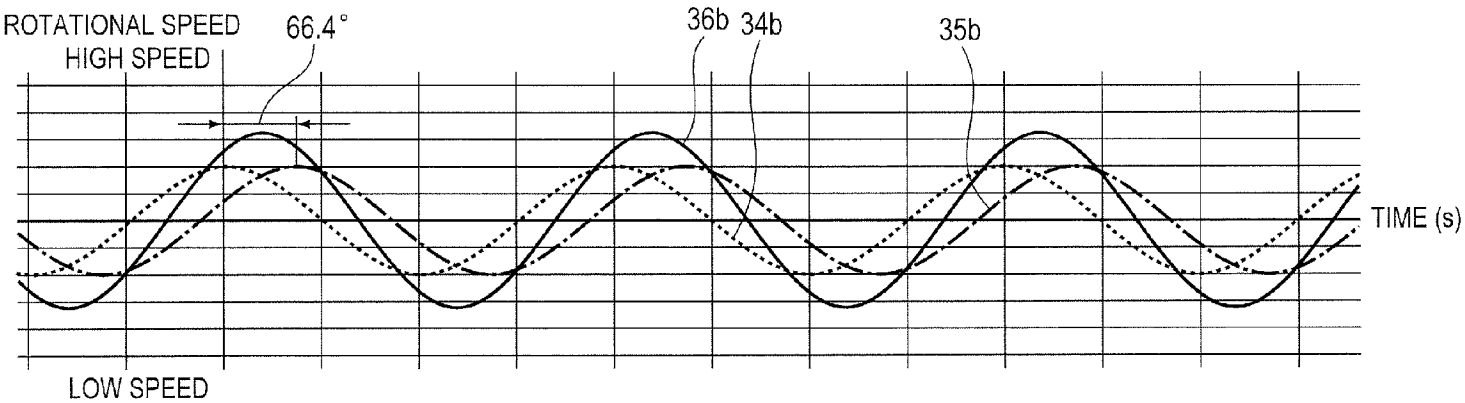
FIG. 8B is a graph illustrating rotational speed fluctuations of a branch gear on the downstream side in the transfer direction.
Figure 9A:
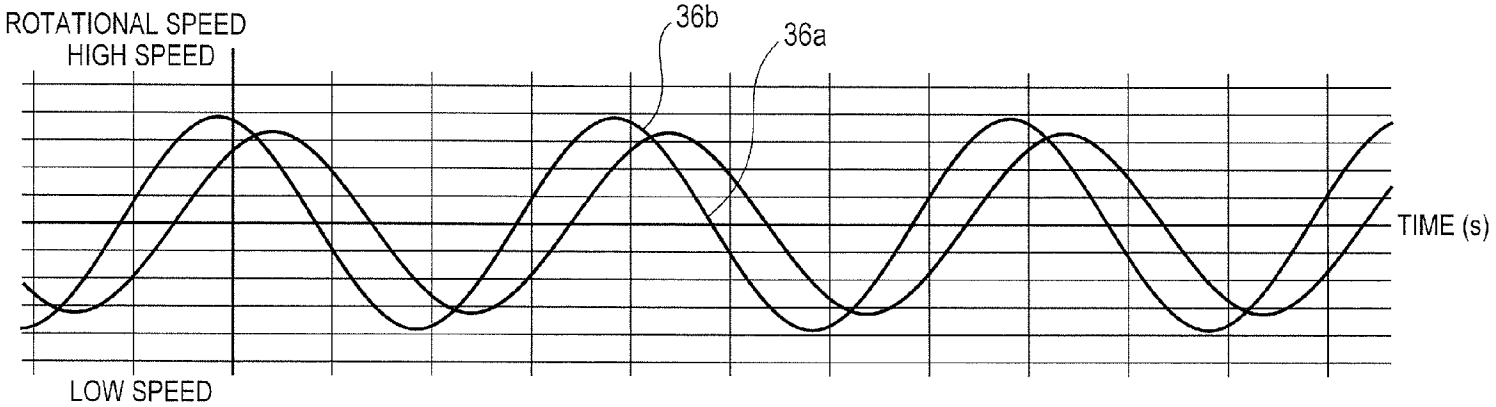
FIG. 9A is a graph illustrating comparison between the rotational speed fluctuations of each of the branch gears on the upstream side in the transfer direction and on the downstream side in the transfer direction.
Figure 9B:
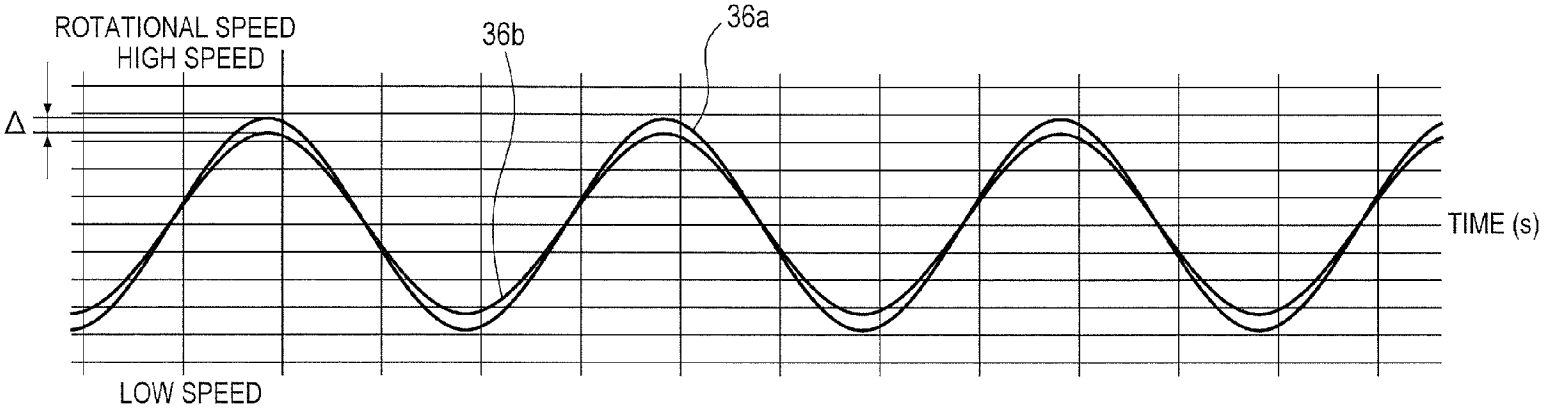
FIG. 9B is another graph illustrating comparison between the rotational speed fluctuations of each of the branch gears on the upstream side in the transfer direction and the downstream side in the transfer direction.

Next, the meshing angles of the right-under idler gears 41 (41*a* and 41*b*), which are the most characteristic configuration of this embodiment, are described. FIG. 5A is a graph illustrating rotational speed fluctuations of the right-under idler gear 41*a* on the upstream side in the transfer direction. FIG. 5B is a graph illustrating rotational speed fluctuations of the right-under idler gear 41*b* on the downstream side in the transfer direction. FIG. 6A is a graph illustrating comparison between the two right-under idler gears 41*a* and 41*b*. FIG. 6B is a graph illustrating a state in which phases of the two right-under idler gears 41*a* and 41*b* are matched each other.

In FIG. 5A, it is assumed that drive is input from the obliquely under idler gear 42*a* at a peak of a speed fluctuation of the right-under idler gear 41*a* on the upstream side. Then, the rotational speed fluctuation at the time of drive output has a peak at a position rotated by 180° from the meshing position between the right-under idler gear 41*a* and the obliquely under idler gear 42*a*. Thus, at the meshing position between the right-under idler gear 41*a* that is rotated by $\theta_3(°)$ (in this embodiment, $\theta_3=214.8°$) and the branch gear 30*a*, a peak of a rotational speed fluctuation 45*a* at the time of drive output lags by a time period corresponding to $\theta_3-180(°)$ (lags by a time period corresponding to $214.8-180=34.8°$) with respect to a rotational speed fluctuation 44*a* at the time of drive input.

Thus, a net rotational speed fluctuation of the right-under idler gear 41*a* on the upstream side is equal to a sum of the rotational speed fluctuation 44*a* at the time of drive input and the rotational speed fluctuation 45*a* at the time of drive output. As a result, a net rotational speed fluctuation is a rotational speed fluctuation 46*a* indicated by a solid line in FIG. 5A.

Similarly, in FIG. 5B, it is assumed that drive is input from the obliquely under idler gear 42*b* at a peak of a speed fluctuation of the right-under idler gear 41*b* on the downstream side. The meshing angle of the right-under idler gear 41*b* is set to be substantially equal to $360-\theta_3(°)$. Thus, a peak of a rotational speed fluctuation 45*b* at the time of drive output lags by a time period corresponding to $(360-\theta_3)-180=180-\theta_3(°)$ with respect to a rotational speed fluctuation 44*b* at the time of drive input. As a result, a net rotational speed fluctuation of the right-under idler gear 41*b* is a rotational speed fluctuation 46*b* indicated by a solid line in FIG. 5B.

In FIG. 6A, the net rotational speed fluctuation 46*a* of the right-under idler gear 41*a* on the upstream side is indicated by a dashed line instead of the solid line in FIG. 5A, and the net rotational speed fluctuation 46*b* of the right-under idler gear 41*b* on the downstream side is indicated by a solid line as in FIG. 5B. As is clear from FIG. 6A, the net rotational speed fluctuations 46*a* and 46*b* of the two right-under idler gears 41 have the same cycle and the same speed fluctuation amount, but are different from each other only in gear phase.

In this state, the rotational speed fluctuation 46*b* of the right-under idler gear 41*b* on the downstream side is shifted in phase by an amount corresponding to $180-\theta_3(°)$ from the rotational speed fluctuation 46*a* of the right-under idler gear 41*a* on the upstream side. A state of this case is illustrated in FIG. 6B is obtained. As a result, the rotational speed fluctuations 46*a* and 46*b* of the two right-under idler gears 41*a* and 41*b* can be matched with each other.

In other words, in FIG. 6B, the meshing phase between the right-under idler gear 41*b* on the downstream side and the obliquely under idler gear 42*b* on the downstream side is shifted substantially by the amount corresponding to $180-\theta_3(°)$ with respect to the meshing phase between the right-under idler gear 41*a* on the upstream side and the obliquely under idler gear 42*a* on the upstream side. With this, meshing cycles, speed fluctuation amounts, and phases of the two right-under idler gears 41*a* and 41*b* can be substantially matched with each other.

Thus, in FIG. 4, on the upstream side, the right-under idler gear 41*a* has a meshing angle $\theta_3$ of 214.8° set between the obliquely under idler gear 42*a* and the branch gear 30*a*. On the downstream side, the right-under idler gear 41*b* has a meshing angle substantially equal to $360-\theta_3(°)$ set between the obliquely under idler gear 42*b* and the branch gear 30*b*. In this embodiment, it is set to $360-214.8=145.2°$.

The meshing phase between the right-under idler gear 41*b* on the downstream side and the obliquely under idler gear 42*b* on the downstream side is set to $180-214.8=-34.8°$ with respect to the meshing phase between the right-under idler gear 41*a* on the upstream side and the obliquely under idler gear 42*a* on the upstream side. In other words, when the meshing phase is shifted by an amount corresponding to 34.8° in a direction opposite to the rotation direction (with reference to two phase alignment marks 41*x* provided on the right-under idler gears 41 illustrated in FIG. 4), the color misregistration between the two colors of Y and C on the upstream side in the transfer direction, which correspond respectively to the right-under idler gears 41, can be reduced.

Similarly, the color misregistration between the two colors of M and K on the downstream side in the transfer direction, which correspond respectively to the right-under idler gears 41, can also be reduced.

In this embodiment, meshing angles of the two obliquely under idler gears 42*a* and 42*b* are set in the same manner as those of the two right-under idler gears 41*a* and 41*b* described above.

Specifically, the two obliquely under idler gears 42*a* and 42*b* have the same shape formed by identical molding or identical processing. When the obliquely under idler gear 42*a* on the upstream side has the meshing angle $\theta_4$ formed between the transmission gear 43 and the right-under idler gear 41*a* on the upstream side, the obliquely under idler gear 42*b* on the downstream side has a meshing angle substantially equal to $360-\theta_4(°)$ formed between the transmission gear 43 and the right-under idler gear 41*b* on the downstream side. The assembling is performed by matching the phases so that the meshing phase between the obliquely under idler gear 42*b* on the downstream side and the transmission gear 43 is shifted substantially by the amount corresponding to $180-\theta_4(°)$ with respect to the meshing phase between the obliquely under idler gear 42*a* on the upstream side and the transmission gear 43.

With this, as in the case of the right-under idler gears 41 (41*a* and 41*b*), the rotational speed fluctuation phases and the rotational speed fluctuation amounts of the two obliquely under idler gears 42*a* and 42*b* can be matched with each other. As a result, the color misregistration between the corresponding two colors, that is, between Y and C and between M and K, can be respectively reduced.

In this embodiment alone, the numbers of teeth of the right-under idler gears 41 and the obliquely under idler gears 42 are set to be equal to each other (number of teeth: 68). The meshing angle $\theta_3$ of the right-under idler gear 41*a* on the upstream side in the transfer direction and the meshing angle $360-\theta_4(°)$ of the obliquely under idler gear 42*b* on the downstream side in the transfer direction satisfy the relationship of $\theta_3 \approx 360-\theta_4(°)$ (where $\theta_3$ is 214.8°, and $360-\theta_4(°)$ is 214.1°) (similarly, $360-\theta_3 \approx \theta_4(°)$).

This case can be described as follows. The drive portions each include the right-under idler gears 41*a* and 41*b* that serve as the "idler gears," and the obliquely under idler gears 42*a* and 42*b* that serve as the "second idler gears," the gears being continuous with each other in a drive transmission direction and equal to each other in numbers of teeth. The right-under idler gears 41*a* and 41*b* respectively form the meshing angle $\theta_3$ as "θk1," and the obliquely under idler gears 42*a* and 42*b* respectively form the meshing angle $\theta_4$ as "θk2." With this configuration, the relationship of $\theta_3+\theta_4=360°$ is established. In other words, when the right-under idler gears 41*a* and 41*b* respectively form the meshing angle θk1, the obliquely under idler gears 42*a* and 42*b* respectively form a meshing angle substantially equal to 360−θk1(°).

The "idler gear" and the "second idler gear" that are provided on the upstream side (first drive portion), and the "idler gear" and the "second idler gear" that are provided on the downstream side (second drive portion) are continuous with each other in the drive transmission direction and equal to each other in numbers of teeth. The right-under idler gears 41*a* and 41*b* and the obliquely under idler gears 42*a* and 42*b* are provided respectively on the upstream side and the downstream side in a conveying direction of the transfer member. The right-under idler gear 41*a* on the upstream side forms the meshing angle $\theta_3$ as "θk11," and the obliquely under idler gear 42*a* on the upstream side forms the meshing angle $\theta_4$ as "θk21." The right-under idler gear 41*b* on the downstream side forms the meshing angle $\theta_3$ as "θk12," and the obliquely under idler gear 42*b* on the downstream side forms the meshing angle $\theta_4$ as "θk22." With this configuration, the relationships of $\theta_3+\theta_4=360°$ and $\theta_3+\theta_4=360°$ are established, respectively.

Thus, all the meshing phases of the right-under idler gears 41 and the obliquely under idler gears 42, that are rotated at the same cycle and by the same eccentric amount, with respect to gears on the upstream side thereof in the drive transmission direction are matched with each other. In other words, the meshing phases of the gears are matched with each other in a manner that the phase alignment marks 41*x* and phase alignment marks 42*x* come to positions on dotted lines in FIG. 4. Also in this case, the color misregistration between the corresponding two colors can be respectively reduced.

In this embodiment, the color misregistration relative to the drive transmission device in the image forming apparatus is described. Also in this case, as in the first embodiment, unless a maximum allowable amount of the color misregistration relative to the drive transmission device is suppressed to approximately ½ dots, that is, approximately 20 μm or less in an image resolution of 600 dpi, it is difficult to form high quality images with the image forming apparatus.

In this embodiment, the right-under idler gear 41*a* on the upstream side in the transfer direction is configured to form the meshing angle $\theta_3$ and the right-under idler gear 41*b* on the downstream side in the transfer direction is configured to form the meshing angle $360-\theta_3(°)$. The right-under idler gear 41*a* and the right-under idler gear 41*b* are assembled so that the meshing phases are 0° and $180-\theta_3(°)$, respectively. With this, theoretical color misregistration relative to the drive transmission device is reduced as much as possible.

At the same time, the obliquely under idler gear 42*a* on the upstream side in the transfer direction is configured to form the meshing angle $\theta_4$ and the obliquely under idler gear 42*b* on the downstream side in the transfer direction is configured to form the meshing angle $360-\theta_4(°)$. The obliquely under idler gear 42*a* and the obliquely under idler gear 42*b* are assembled so that the meshing phases are 0° and $180-\theta_4(°)$, respectively. With this, theoretical color misregistration relative to the drive transmission device is reduced as much as possible.

In this embodiment, between the corresponding two colors (in this embodiment, between Y and C and between M and K), a range of the meshing angle of each of the two right-under idler gears 41*a* and 41*b*, in which the maximum allowable amount of the color misregistration is suppressed to 20 μm, is ±31.8° when accuracy of the gears is equivalent to Level 2 conforming to the standard of JGMA. Thus, the advantage of the present invention can be obtained as long as the right-under idler gear 41*b* on the downstream side in the transfer direction forms a meshing angle that falls within a range of from 113.4° to 246.6° with respect to an optimum meshing angle of 145.2° when the right-under idler gear 41*a* on the upstream side in the transfer direction forms a meshing angle of 214.8°.

Similarly, between the corresponding two colors (in this embodiment, between Y and C and between M and K), a range of the gear meshing phase of each of the two right-under idler gears 41*a* and 41*b*, in which the maximum allowable amount of the color misregistration is suppressed to 20 μm, is ±16.7° when accuracy of the gears is equivalent to Level 2 conforming to the standard of JGMA. Thus, the advantage of the present invention can be obtained as long as the right-under idler gear 41*b* on the downstream side in the transfer direction has a phase that falls within a range of from −51.5° to −18.1° with respect to an optimum phase of −34.8° relative to the phase of the right-under idler gear 41*a* on the upstream side in the transfer direction.

Similarly, between the corresponding two colors (in this embodiment, between Y and C and between M and K), a range of the meshing angle of each of the two obliquely under idler gears 42*a* and 42*b*, in which the maximum allowable amount of the color misregistration is suppressed to 20 μm, is ±31.8° when accuracy of the gears is equivalent to Level 2 conforming to the standard of JGMA. Thus, the advantage of the present invention can be obtained as long as the obliquely under idler gear 42*b* on the downstream side in the transfer direction forms a meshing angle that falls within a range of from 182.3° to 245.9° with respect to an optimum meshing angle of 214.1° when the obliquely under idler gear 42*a* on the upstream side in the transfer direction forms a meshing angle of 145.9°.

Similarly, between the corresponding two colors (in this embodiment, between Y and C and between M and K), a range of the gear meshing phase of each of the two obliquely under idler gears 42*a* and 42*b*, in which the maximum allowable amount of the color misregistration is suppressed to 20 μm, is ±16.7° when accuracy of the gears is equivalent to Level 2 conforming to the standard of JGMA. Thus, the advantage of the present invention can be obtained as long as the obliquely under idler gear 42*b* on the downstream side in the transfer direction has a gear meshing phase that falls within a range of from 17.4° to 50.8° with respect to an optimum gear meshing phase of 34.1° relative to the gear meshing phase of the obliquely under idler gear 42*a* on the upstream side in the transfer direction.

At the same time in this embodiment, similarly to the first embodiment, between the corresponding two colors (in this embodiment, between Y and C and between M and K), a range of the meshing angle of each of the two branch gears 30*a* and 30*b*, in which the maximum allowable amount of the color misregistration is suppressed to 20 μm, is ±31.8° when accuracy of the gears is equivalent to Level 2 conforming to the standard of JGMA. Thus, the advantage of the present invention can be obtained as long as the branch gear 30*b* on the downstream side in the transfer direction forms a meshing angle that falls within a range of from 187.4° to 251° with respect to an optimum meshing angle of 219.2° when the branch gear 30*a* on the upstream side in the transfer direction forms a meshing angle of 219.2°.

Similarly, between the corresponding two colors (in this embodiment, between Y and C and between M and K), a range of the gear meshing phase of each of the two branch gears 30*a* and 30*b*, in which the maximum allowable amount of the color misregistration is suppressed to 20 μm, is ±16.7° when accuracy of the gears is equivalent to Level 2 conforming to the standard of JGMA. Thus, the advantage of the present invention can be obtained as long as the branch gear 30*b* on the downstream side in the transfer direction has a gear meshing phase that falls within a range of from −16.7° to 16.7° with respect to an optimum gear meshing phase of 0° relative to the gear meshing phase of the branch gear 30*a* on the upstream side in the transfer direction.

Similarly, as in this embodiment, as long as the numbers of teeth of the right-under idler gears 41 and the obliquely under idler gears 42 are equal to each other, and as long as the meshing angle of the right-under idler gear 41 on any one of the upstream side and the downstream side in the transfer direction is substantially equal to the meshing angle of the obliquely under idler gear 42 on another of the upstream side and the downstream side, the advantage of the present invention can be obtained as described below. Specifically, when accuracy of the gears is equivalent to Level 2 conforming to the standard of JGMA, even when the meshing phase of the right-under idler gear 41*b* on the downstream side in the transfer direction and the meshing phase of the obliquely under idler gear 42*b* on the downstream side in the transfer direction are shifted with respect to the meshing phase of the right-under idler gear 41*a* on the upstream side in the transfer direction and the meshing phase of the obliquely under idler gear 42*a* on the upstream side in the transfer direction, respectively, by a value that falls within a range of from −16.7° to +16.7° with respect to an optimum value of 0°.

In accordance with changes in accuracy and number of teeth of the gear, the maximum allowable amount of the color misregistration between the two colors is suppressed to 20 μm at different angles. Thus, the scope of the present invention includes all the range of combinations in which the maximum allowable amount of the color misregistration between the two colors is suppressed to 20 μm in the drive transmission device as a whole.

According to the configuration of the first embodiment or the second embodiment, all the meshing angles of the branch gears 30*a* and 30*b* between the drive gears 18Y to 18K and the motor gears G1 and G2, can be optimized. Thus, the color misregistration can be suppressed.

In the second embodiment, the right-under idler gears 41*a* and 41*b* and the obliquely under idler gears 42*a* and 42*b* are continuously provided between the branch gears 30*a* and 30*b* and the transmission gear 43. However, the present invention is not limited to this configuration. That is, the right-under idler gears 41*a* and 41*b* may be omitted from between the branch gears 30*a* and 30*b* and the transmission gear 43, and drive forces may be transmitted through the obliquely under idler gears 42*a* and 42*b*.

In a case that a meshing position of the branch gear 30*a* for the obliquely under idler gear 42*a* as an "input side gear" rotates to meshing positions of the branch gear 30*a* for the drive gears 18Y and 18M as "output side gears" along a pitch circle of the branch gear 30*a* on the upstream side, the meshing angles respectively are $\theta_3$ and $\theta_4$ as "θk". In this case, in a case that a meshing position of the branch gear 30*b* for the obliquely under idler gear 42*b* as an "input side gear" rotates to meshing positions of the branch gear 30*b* for the drive gears 18C and 18K as "output side gears" along a pitch circle of the branch gear 30*b* on the downstream side, the meshing angles respectively are substantially equal to $360-\theta_3(°)$ and $360-\theta_4(°)$. The meshing phases of the branch gear 30*b* on the downstream side lead respectively by the angles substantially equal to $180-\theta_3(°)$ and $180-\theta_4(°)$ with respect to the meshing phases of the branch gear 30*a* on the upstream side.

According to this embodiment, all the meshing angles of the idler gears between the drive gears and the transmission gear, can be optimized. Thus, the color misregistration can be suppressed.

In each of the first embodiment and the second embodiment, the branch gears mesh with the drive gears. However, the present invention is not limited to this configuration. That is, additional idler gears may be interposed between the drive gears and the branch gears so that drive forces are transmitted by the additional idler gears therebetween. Further, in each of the first embodiment and the second embodiment, the intermediate transfer belt 12*a* is described as a transfer member. However, the configurations of the first embodiment and the second embodiment are applicable to a configuration in which an electrostatic conveyor belt is used instead of the intermediate transfer belt 12*a*. In that case, the sheet S conveyed by the electrostatic conveyer belt corresponds to the transfer member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-273594, filed Dec. 14, 2012, and Japanese Patent Application No. 2013-246517, filed Nov. 28, 2013, which are hereby incorporated by reference herein in their entirety.

What is claimed is:

1. An image forming apparatus, comprising:

a first photosensitive drum;

a second photosensitive drum;

a first drive portion which transmits a first drive force to the first photosensitive drum, the first drive portion having a first transmission gear rotated by the first drive force, a first idler gear rotated in mesh with the first transmission gear, and a first drive gear meshing with the first idler gear to transmit the first drive force to the first photosensitive drum;

a second drive portion which transmits a second drive force to the second photosensitive drum, the second drive portion having a second transmission gear rotated by the second drive force, a second idler gear rotated in mesh with the second transmission gear, and a second drive gear meshing with the idler gear to transmit the second drive force to the second photosensitive drum;

a first phase detection flag provided on the first transmission gear;

a second phase detection flag provided on the second transmission gear;

a first sensor cooperating with the first phase detection flag to detect a phase of the first transmission gear; and a second sensor cooperating with the second phase detection flag to detect a phase of the second transmission gear, wherein the first transmission gear and the second transmission gear have the same shape, the first idler gear and the second idler gear have the same shape, and the first drive gear and the second drive gear have the same shape, wherein a rotational speed fluctuation phase of the first transmission gear and a rotational speed fluctuation phase of the second transmission gear match with each other, wherein the first photosensitive drum is exposed to form a latent image and the latent image is formed into a first toner image through visualization with toner, the second photosensitive drum is exposed to form a latent image and the latent image is formed into a second toner image through visualization with toner, and the first toner image and the second toner image are transferred respectively from the first photosensitive drum and the second photosensitive drum onto a moving transfer member and superimposed to form an image, wherein the first photosensitive drum transfers the first toner image onto the transfer member at a first position, and the second photosensitive drum transfers the second toner image onto the transfer member at a second position that is downstream from the first position in a transfer member moving direction, wherein a time period from when the first photosensitive drum is exposed to form the latent image to when the first toner image is transferred onto the transfer member at the first position is substantially equal to a time period from when the second photosensitive drum is exposed to form the latent image to when the second toner image is transferred onto the transfer member at the second position, wherein the first drive portion and the second drive portion are arranged in a manner that a time period in which the transfer member moves from the first position to the second position is substantially equal to an integral multiple of a drive cycle of each of the first and second idler gears, wherein the first idler gear has a first phase alignment mark and the second idler gear has a second phase alignment mark, wherein, when a first meshing angle is an angle from the first phase alignment mark to a meshing position between the first idler gear and the first drive gear in a rotation direction of the first idler gear with respect to a rotation center of the first idler gear, and when a second meshing angle is an angle from the second phase alignment mark to a meshing position between the second idler gear and the second drive gear in a rotation direction of the second idler gear with respect to a rotation center of the second idler gear, the first meshing angle and the second meshing angle are substantially equal to each other, and a rotational phase of the first idler gear and a rotational phase of the second idler gear substantially match with each other, and wherein the first and second idler gears are respectively matched in phase by the first and second phase alignment marks so that the first and second idler gears are in the same phase with respect to the first and second transmission gears.

2. An image forming apparatus according to claim 1, further comprising a third photosensitive drum and a fourth photosensitive drum, wherein the first drive portion further has a third drive gear which transmits the first drive force to the third photosensitive drum, and the first idler gear meshes with the third drive gear, and wherein the second drive portion further has a fourth drive gear which transmits the second drive force to the fourth photosensitive drum, and the second idler gear meshes with the fourth drive gear.

3. An image forming apparatus according to claim 1, wherein the first drive gear is provided coaxially and integrally with a rotary shaft of the first photosensitive drum, and the second drive gear is provided coaxially and integrally with a rotary shaft of the second photosensitive drum.

4. An image forming apparatus according to claim 1, further comprising:

a first drive source which rotates the first transmission gear; and a second drive source which rotates the second transmission gear, wherein the first transmission gear is provided integrally with a rotary shaft of the first drive source and the second transmission gear is provided integrally with a rotary shaft of the second drive source.

5. An image forming apparatus according to claim 1, wherein the first transmission gear and the second transmission gear are rotated in the same phase and at the same speed.

6. An image forming apparatus according to claim 1, wherein the first meshing angle and the second meshing angle are 219.2°.

7. An image forming apparatus, comprising:

a first photosensitive drum;

a second photosensitive drum;

a first drive portion which transmits a first drive force to the first photosensitive drum, the first drive portion having a first transmission gear rotated by the first drive force, a first idler gear rotated in mesh with the first transmission gear, and a first drive gear meshing with the first idler gear to transmit the first drive force to the first photosensitive drum;

a second drive portion which transmits a second drive force to the second photosensitive drum, the second drive portion having a second transmission gear rotated by the second drive force, a second idler gear rotated in mesh with the second transmission gear, and a second drive gear meshing with the second idler gear to transmit the second drive force to the second photosensitive drum, a first phase detection flag provided on the first transmission gear;

a second phase detection flag provided on the second transmission gear;

a first sensor cooperating with the first phase detection flag to detect a phase of the first transmission gear; and a second sensor cooperating with the second phase detection flag to detect a phase of the second transmission gear, wherein the first transmission gear and the second transmission gear have the same shape, the first idler gear and the second idler gear have the same shape, and the first drive gear and the second drive gear have the same shape, wherein the first photosensitive drum is exposed to form a latent image and the latent image is formed into a first toner image through visualization with toner, the second photosensitive drum is exposed to form a latent image and the latent image is formed into a second toner image through visualization with toner, and the first toner image and the second toner image are transferred respectively from the first photosensitive drum and the second photosensitive drum onto a moving transfer member and superimposed to form an image, wherein the first photosensitive drum transfers the first toner image onto the transfer member at a first position, and the second photosensitive drum transfers the second toner image onto the transfer member at a second position that is downstream from the first position in a transfer member moving direction, wherein a time period from when the first photosensitive drum is exposed to form the latent image to when the first toner image is transferred onto the transfer member at the first position is substantially equal to a time period from when the second photosensitive drum is exposed to form the latent image to when the second toner image is transferred onto the transfer member at the second position, wherein the first drive portion and the second drive portion are arranged in a manner that a time period in which the transfer member moves from the first position to the second position is substantially equal to an integral multiple of a drive cycle of each of the first and second idler gears, wherein the first idler gear has a first phase alignment mark and the second idler gear has a second phase alignment mark, wherein, when the first and second transmission gears are driven so that rotational speed fluctuation phases thereof match with each other, the second phase alignment mark locates on a line connecting a rotation center of the second transmission gear and a rotation center of the second idler gear at a timing to locate the first phase alignment mark on a line connecting a rotation center of the first transmission gear and a rotation center of the first idler gear, and wherein the first and second idler gears are respectively matched in phase by the first and second phase alignment marks so that the first and second idler gears are in same phase with respect to the first and second transmission gears.

8. An image forming apparatus according to claim 7, further comprising a third photosensitive drum and a fourth photosensitive drum, wherein the first drive portion further has a third drive gear which transmits the first drive force to the third photosensitive drum, and the first idler gear meshes with the third drive gear, wherein the second drive portion further has a fourth drive gear which transmits the second drive force to the fourth photosensitive drum, and the second idler gear meshes with the fourth drive gear.

9. An image forming apparatus according to claim 7, wherein the first drive gear is provided coaxially and integrally with a rotary shaft of the first photosensitive drum, and the second drive gear is provided coaxially and integrally with a rotary shaft of the second photosensitive drum.

10. An image forming apparatus according to claim 7, further comprising:

a first drive source which rotates the first transmission gear; and a second drive source which rotates the second transmission gear, wherein the first transmission gear is provided integrally with a rotary shaft of the first drive source and the second transmission gear is provided integrally with a rotary shaft of the second drive source.

11. An image forming apparatus according to claim 7, wherein the first transmission gear and the second transmission gear are rotated in the same phase and at the same speed.

* * * * *